US011521542B2

(12) United States Patent
Wei et al.

(10) Patent No.: US 11,521,542 B2
(45) Date of Patent: Dec. 6, 2022

(54) METHOD FOR DISPLAY DRIVER SYSTEM AND DISPLAY DRIVER SYSTEM

(71) Applicant: NOVATEK Microelectronics Corp., Hsin-Chu (TW)

(72) Inventors: Hsu-Chih Wei, Chiayi (TW); Po-Hsiang Fang, Hsinchu (TW); Keko-Chun Liang, Hsinchu (TW); Che-Wei Yeh, Hsinchu (TW); Ju-Lin Huang, Hsinchu County (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 16/953,364

(22) Filed: Nov. 20, 2020

(65) Prior Publication Data

US 2021/0150976 A1 May 20, 2021

Related U.S. Application Data

(60) Provisional application No. 62/937,802, filed on Nov. 20, 2019.

(51) Int. Cl.
*G09G 3/20* (2006.01)
*G09G 3/32* (2016.01)

(52) U.S. Cl.
CPC ..... *G09G 3/32* (2013.01); *G09G 2330/023* (2013.01); *G09G 2370/00* (2013.01)

(58) Field of Classification Search
CPC ..... G09G 2330/02; G09G 2330/023; G09G 2370/00; G09G 2370/08; G09G 3/2085; G09G 3/32; G09G 5/36
See application file for complete search history.

(56) References Cited

U.S. PATENT DOCUMENTS 8,380,905 B2 2/2013 Djabbari et al.
9,274,997 B2 3/2016 Berenbaum et al.
(Continued)

FOREIGN PATENT DOCUMENTS

CN 100418078 C 9/2008
CN 102077266 A 5/2011
(Continued)

OTHER PUBLICATIONS

Ishtiaque Amin, Daisy Chain Implementation for Serial Peripheral Interface, Application Report, Texas Instruments, Aug. 2018.

*Primary Examiner* — Ram A Mistry
(74) *Attorney, Agent, or Firm* — Marshall, Gerstein & Borun LLP

(57) ABSTRACT

The present disclosure provides a method for a display driver system and a display driver system. The method comprises: the control circuit transmitting a global signal and a first signal for a LED driver circuit in each stage to a first-stage LED driver circuit, wherein the global signal includes an command for indicating an operation mode of the LED driver circuit in each stage; the LED driver circuit in each stage determining the operation mode corresponding to the command according to the global signal, identifying a corresponding first signal of the LED driver circuit in the stage, and operating according to the determined operation mode and the corresponding first signal; and the LED driver circuit in each stage except for last stage transmitting the global signal to the LED driver circuit in its next stage, and in response to a completion of operation according to the determined operation mode and the corresponding first signal, transmitting the first signal for the LED driver circuit in each of sequential stages to the LED driver circuit in its next stage.

22 Claims, 14 Drawing Sheets

(56) References Cited

U.S. PATENT DOCUMENTS

| | | | | |
|---|---|---|---|---|
| 10,153,257 | B2 | 12/2018 | Cok et al. | |
| 10,262,567 | B2 | 4/2019 | Cok et al. | |
| 10,397,021 | B2 | 8/2019 | Kessler et al. | |
| 2004/0252112 | A1* | 12/2004 | Fukuda | G09G 3/3611 345/204 |
| 2006/0017664 | A1* | 1/2006 | Takagi | G09G 3/3283 345/76 |
| 2010/0225657 | A1* | 9/2010 | Sakariya | G09G 3/20 345/545 |
| 2016/0180821 | A1* | 6/2016 | Chang | G09G 3/3413 345/531 |
| 2017/0047027 | A1* | 2/2017 | Nambi | G09G 3/36 |
| 2020/0265003 | A1 | 8/2020 | Schmitz | |

FOREIGN PATENT DOCUMENTS

| | | | |
|---|---|---|---|
| CN | 102402949 | A | 4/2012 |
| CN | 102750975 | B | 9/2015 |
| CN | 107025200 | A | 8/2017 |
| CN | 110309820 | B | 1/2020 |

* cited by examiner

METHOD FOR DISPLAY DRIVER SYSTEM AND DISPLAY DRIVER SYSTEM

CROSS REFERENCE TO RELATED APPLICATIONS

The present disclosure claims priority to U.S. Provisional Application No. 62/937,802, filed on Nov. 20, 2019, entitled "protocol for differential cascade driver system", which is incorporated into the present disclosure by reference in its entirety.

TECHNICAL FIELD

The present disclosure relates to an electronic apparatus, and more particularly, to a method for a display driver system and a corresponding display driver system.

BACKGROUND

Serial Peripheral Interface (SPI) has been applied to a cascade Light-Emitting Diode (LED) driver system to provide a communication interface between a control circuit and a plurality of light-emitting diode driver circuits in the LED driver system. Under this structure, when the control circuit is to write data to or read data from the LED driver circuits, the control circuit is required to determine the LED driver circuit corresponding to the data through a determination mechanism such as employing additional pins or chip selection signals.

However, SPI has many defects. Specifically, the transmission voltage swing is large, for example, the input high level (VIH) is 4.6V, and the input low level (VIL) is 0V, which makes the data transmission speed relatively slow. In addition, SPI uses multi-drop in frequency, which is greatly influenced by environmental noise and has high power consumption and poor Electro-Static discharge (ESD) tolerance.

Therefore, there is a need for a novel display driver system and a method for the display driver system.

SUMMARY OF THE INVENTION

Therefore, the present disclosure provides a method for a display driver system and a corresponding display driver system.

According to one aspect of the present disclosure, a method for a display driver system is provided, wherein the display driver system includes a control circuit and a cascade-connected multi-stage LED driver circuit, and the method comprises: the control circuit transmitting a global signal and a first signal for a LED driver circuit in each stage to a first-stage LED driver circuit in the multi-stage LED driver circuit, wherein the global signal includes an command for indicating an operation mode of the LED driver circuit in each stage; the LED driver circuit in each stage determining the operation mode corresponding to the command according to the global signal, identifying a corresponding first signal of the LED driver circuit in the stage, and operating according to the determined operation mode and the corresponding first signal; and the LED driver circuit in each stage except for the LED driver circuit in the last stage transmitting the global signal to the LED driver circuit in its next stage, and in response to a completion of operation according to the determined operation mode and the corresponding first signal, transmitting the first signal for the LED driver circuit in each stage after the LED driver circuit in the stage to the LED driver circuit in its next stage.

According to another aspect of the present disclosure, a display driver system is provided, comprising: a control circuit and a cascade-connected multi-stage LED driver circuit, wherein the control circuit is configured to transmit a global signal and a first signal for a LED driver circuit in each stage to the first-stage LED driver circuit in the multi-stage LED driver circuit, wherein the global signal includes an command for indicating an operation mode of the LED driver circuit in each stage; the LED driver circuit in each stage is configured to determine the operation mode corresponding to the command according to the global signal, to identify a corresponding first signal of the LED driver circuit in the stage, and to operate according to the determined operation mode and the corresponding first signal; and the LED driver circuit in each stage except for the LED driver circuit in the last stage is further configured to transmit the global signal to the LED driver circuit in its next stage, and to, in response to a completion of operation according to the determined operation mode and the corresponding first signal, transmit the first signal for the LED driver circuit in each stage after the LED driver circuit in the stage to the LED driver circuit in its next stage.

In order to make the above features and advantages of the present disclosure more comprehensible, embodiments are listed below, and are described in detail in combination with the accompanying drawings.

BRIEF DESCRIPTION OF THE DRAWINGS

The accompanying drawings are used to provide a further understanding of embodiments of the present disclosure, and constitute a part of the specification, and are used to explain the present disclosure together with the embodiments of the present disclosure, and do not constitute a limitation to the present disclosure. Throughout the accompanying drawings, the same reference numerals generally represent the same components or steps.

DESCRIPTION OF THE EMBODIMENTS

Figure 1:
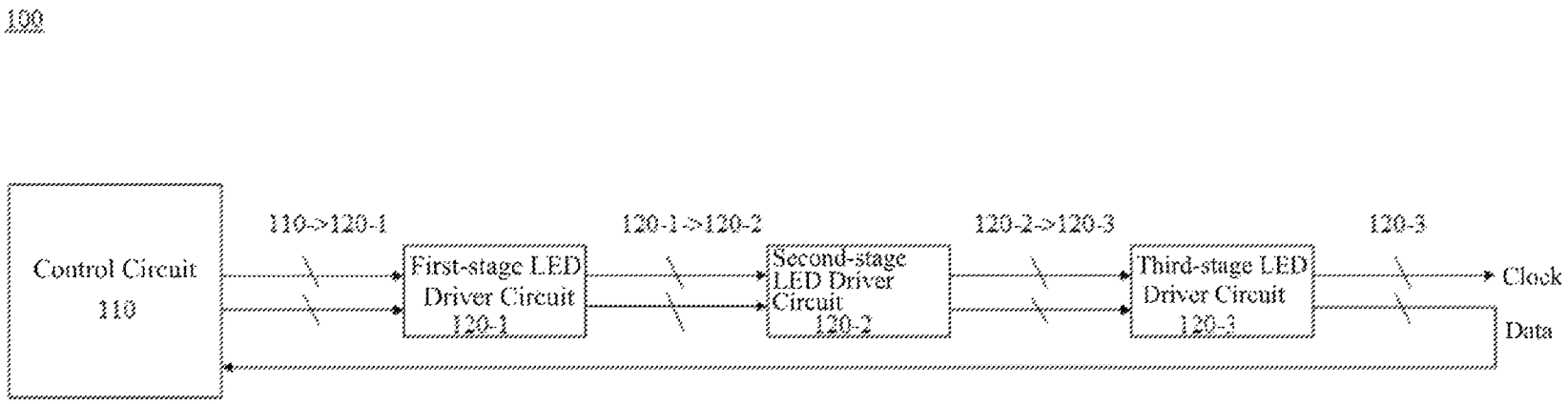
FIG. 1 shows a schematic diagram of a display driver system according to the embodiments of the present disclosure.

The term "coupled (or connected)" used in the full text of this disclosure (including the claims) may refer to any direct or indirect connection means. For example, if it is described in the text that a first apparatus is coupled (or connected) to a second apparatus, it should be interpreted as that the first apparatus may be directly connected to the second apparatus, or the first apparatus may be indirectly connected through other apparatus or some kind of connection means to the second apparatus. The terms "first" and "second" mentioned in the full text of this disclosure (including the claims) are used to name the element (element), or to distinguish different embodiments or scopes, and are not used to restrict an upper or lower limit of the number of elements, and are not used to restrict an order of the elements. In addition, wherever possible, elements/components/steps with the same reference signs in the drawings and embodiments represent the same or similar parts. Elements/components/steps using the same reference signs or using the same terms in different embodiments may refer to related descriptions.

In the present disclosure, the display driver system may include a control circuit and a cascade-connected multi-stage LED (LED) driver circuit. Specifically, the output terminal of the control circuit may be connected to the input terminal of a LED driver circuit in the first stage (hereinafter, a first-stage LED driver circuit) in the multi-stage LED driver circuit. The output terminal of the LED driver circuit in each stage except for the LED driver circuit in the last stage may be connected to the input terminal of the LED driver circuit in its next stage. The output terminal of the LED driver circuit in the last stage may be connected to the input terminal of the control circuit. In addition, the control circuit may be configured with two output terminals, and the LED driver circuit in each stage may be configured with two input terminals and two output terminals, which are used to transmit clock signals and data signals, respectively.

It should be understood that the control circuit may be configured with more than two output terminals, and the LED driver circuit in each stage may be configured with more than two input terminals and more than two output terminals in order to transmit other signals (For example, a synchronization signal described below).

FIG. 1 shows a schematic diagram of a display driver system according to the embodiments of the present disclosure. As shown in FIG. 1, the display driver system 100 may include a control circuit 110 and a three-stage LED driver circuit, the three-stage LED driver circuit including a first-stage LED driver circuit 120-1, a second-stage LED driver circuit 120-2 (the LED driver circuit in the second stage) and a third-stage LED driver circuit 120-3 (the LED driver circuit in the third stage). A first output terminal of the control circuit 110 may be connected to a first input terminal of the first-stage LED driver circuit 120-1, and a first output terminal of the first-stage LED driver circuit 120-1 may be connected to a first input terminal of the second-stage LED driver circuit 120-2, and a first output terminal of the second-stage LED driver circuit 120-2 may be connected to a first input terminal of the third-stage LED driver circuit 120-3. This path may be a path for the control circuit to transmit clock signals to the three-stage LED driver circuit. In addition, a second output terminal of the control circuit 110 may be connected to a second input terminal of the first-stage LED driver circuit 120-1, and a second output terminal of the first-stage LED driver circuit 120-1 may be connected to a second input terminal of the second-stage LED driver circuit 120-2, and a second output terminal of the second-stage LED driver circuit 120-2 may be connected to a second input terminal of the third-stage LED driver circuit 120-3. A second output terminal of the third-stage LED driver circuit 120-3 may be connected to the input terminal of the control circuit 110. This path may be a path for the control circuit to transmit data signals to the three-stage LED driver circuit.

For the display driver system of the present disclosure, a signal transmission protocol may be designed, so that the control circuit and the LED driver circuit in each stage in the display driver system may communicate according to the signal transmission protocol. Operation modes of the LED driver circuit in each stage may include one or more of a write mode, a read mode, a power saving mode, and a power on protection mode. The signal transmission protocol may be designed for the above operation modes.

Specifically, for the write mode and/or the read mode, the signal transmission protocol may specify the following: the control circuit sequentially transmits a global signal and a first signal for the LED driver circuit in each stage to the first-stage LED driver circuit in the multi-stage LED driver circuit, where the global signal includes a command for indicating an operation mode (write mode or read mode) of the LED driver circuit in each stage; when identifying the global signal, the first-stage LED driver circuit determines a corresponding operation mode according to the global signal, and transmits the global signal to the LED driver circuit in its next stage (i.e., the second stage) so that the LED driver circuit in the next stage (i.e., the second stage) also determines the corresponding operation mode according to the global signal and transmits the global signal to the LED driver circuit in its next stage (i.e., the third stage) when identifying the global signal, until the LED driver circuit in the last stage obtains the global signal and determines the corresponding operation mode; after receiving the global signal, the first-stage LED driver circuit identifies a first signal transmitted by the control circuit for the first-stage LED driver circuit, operates according to the determined operation mode and the corresponding first signal, and enters a state of bypass after the operation is completed (i.e., the first-stage LED driver circuit does not process the received signals but transmits the received signals to the LED driver circuit in its next stage, that is, after the operation is completed, the first-stage LED driver circuit does not process the first signals received from the control circuit for the remaining LED driver circuits but transmits them to the LED driver circuit in its next stage). The LED driver circuit in each stage except for the LED driver circuit in the last stage performs similar actions to the first-stage LED driver circuit, until the LED driver circuit in the last stage operates according to the determined operation mode and corresponding first signal.

In addition, for the power saving mode, the signal transmission protocol may specify the following: the control circuit transmits another global signal (represented as a second global signal, and the global signal mentioned regarding the read/write operation being represented as a first global signal) to the first-stage LED driver circuit in the multi-stage LED driver circuit, where the second global signal includes an command for indicating a second operation mode (power saving mode) of the LED driver circuit in each stage; when identifying the second global signal, the first-stage LED driver circuit determines the corresponding operation mode according to the second global signal, and transmits the second global signal to the LED driver circuit in its next stage (i.e., the second stage), so that the LED driver circuit in the next stage (i.e., the second stage) also determines the corresponding operation mode according to the second global signal and transmits the second global signal to the LED driver circuit in its next stage (i.e., the third stage) when identifying the second global signal, until the LED driver circuit in the last stage obtains the second global signal and determines the corresponding operation mode. Alternatively, for the power saving mode, the signal transmission protocol may also specify the following: the first-stage LED driver circuit judges whether a time period during which it receives specific data from the control circuit is greater than a preset threshold, and if so, the current operation mode is changed to the power saving mode; the LED driver circuit in each stage except for the first-stage LED driver circuit judges whether a time period during which it receives specific data from the LED driver circuit in its previous stage is greater than a preset threshold, and if so, the current operation mode is changed to the power saving mode.

In addition, for the power on protection mode, the signal transmission protocol may specify the following: i. the control circuit changes a level of a synchronous signal transmitted by the control circuit to the LED driver circuit in each stage according to a preset cycle; the control circuit transmits first preset data to the first-stage LED driver circuit after the control circuit is powered on and before the control circuit transmits the global signal and the first signal for the LED driver circuit in each stage to the first-stage LED driver circuit in the multi-stage LED driver circuit; ii. the LED driver circuit in each stage in the multi-stage LED driver circuit performs the following operations: transmitting second preset data to its downstream circuit when the first preset data is not received or when the first preset data is received but the level of the synchronization signal has not changed for a preset number of times; transmitting the first preset data to its downstream circuit when the first preset data is received and the level of the synchronization signal has changed for the preset number of times; wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage; iii. in response to receiving the first preset data from the LED driver circuit in the last stage, the control circuit starts to transmit the global signal and the first signal for the LED driver circuit in each stage to the first-stage LED driver circuit in the multi-stage LED driver circuit.

Through the above signal transmission protocol, each LED driver circuit in the display driver system may identify the data that is to be transmitted from the control circuit to itself, so that no additional pins or chip select signals are required to determine the corresponding LED driver circuit, thereby avoiding the use of SPI and thus avoiding some defects caused by SPI.

In addition, in the present disclosure, the "control circuit" may be but is not limited to a timing controller. In addition, the "LED driver circuit" in the present disclosure may be an integrated circuit (IC).

Figure 2A:
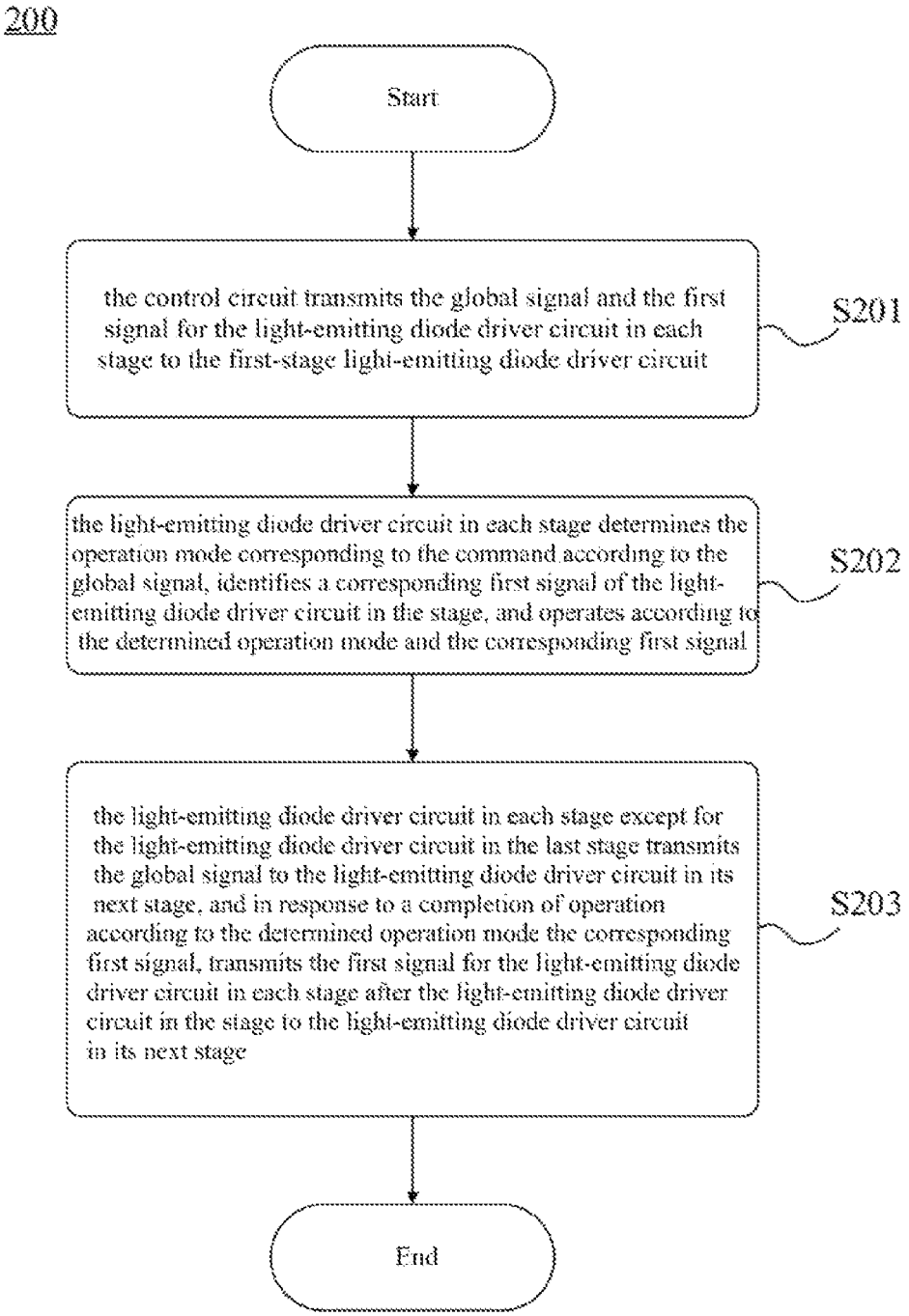
FIG. 2A is a flowchart of a method in which the display driver system performs write and/or read operations according to the embodiments of the present disclosure.

The specific flow in which the display driver system performs the write and/or read operation according to the signal transmission protocol described above will be described below in combination with FIG. 2A. FIG. 2A is a flowchart of a method for the display driver system to perform write and/or read operations according to the embodiments of the present disclosure.

As shown in FIG. 2A, the method 200 includes three steps, namely step S201, step S202, and step S203, respectively. Specifically, in step S201, the control circuit transmits a global signal and a first signal for a LED driver circuit in each stage to a first-stage LED driver circuit in the multi-stage LED driver circuit, where the global signal includes the command for indicating an operation mode of the LED driver circuit in each stage. In step S202, the LED driver circuit in each stage determines the operation mode corresponding to the command according to the global signal, identifies the corresponding first signal of the LED driver circuit in the stage, and operates according to the determined operation mode and the corresponding first signal. In step S203, the LED driver circuit in each stage except for the LED driver circuit in the last stage transmits the global signal to the LED driver circuit in its next stage, and in response to a completion of operation according to the determined operation mode and the corresponding first signal, transmits the first signal for the LED driver circuit in each stage after the LED driver circuit in the stage (i.e., first signals for remaining LED driver circuits) to the LED driver circuit in its next stage.

It should be realized that the performance order of step S202 and step S203 is not that step S202 is performed before step S203, but that some sub-steps in step S202 and step S203 are performed first, and then some of the other steps in step S202 and step S203 are performed. Specifically, after the control circuit transmits the global signal to the first-stage LED driver circuit in the multi-stage LED driver circuit, as described in step S201, the sub-step in step S202 (the LED driver circuit in each stage determines the operation mode corresponding to the command according to the global signal) and the sub-step in step S203 (the LED driver circuit in each stage except for the LED driver circuit in the last stage transmits the global signal to the LED driver circuit in its next stage) may be performed. After the control circuit transmits the first signal for the LED driver circuit in each stage to the first-stage LED driver circuit in the multi-stage LED driver circuit, as described in step S201, another sub-step in step S202 (the LED driver circuit in each stage identifies the corresponding first signal of the LED driver circuit in the stage, and operates according to the determined operation mode and the corresponding first signal) and another sub-step in step S203 (in response to the completion of the operation according to the determined operation mode and the corresponding first signal, the LED driver circuit in each stage except for the LED driver circuit in the last stage transmits the first signal for the LED driver circuit in each stage after the LED driver circuit in the stage to the LED driver circuit in its next stage) may be performed.

Figure 2B:
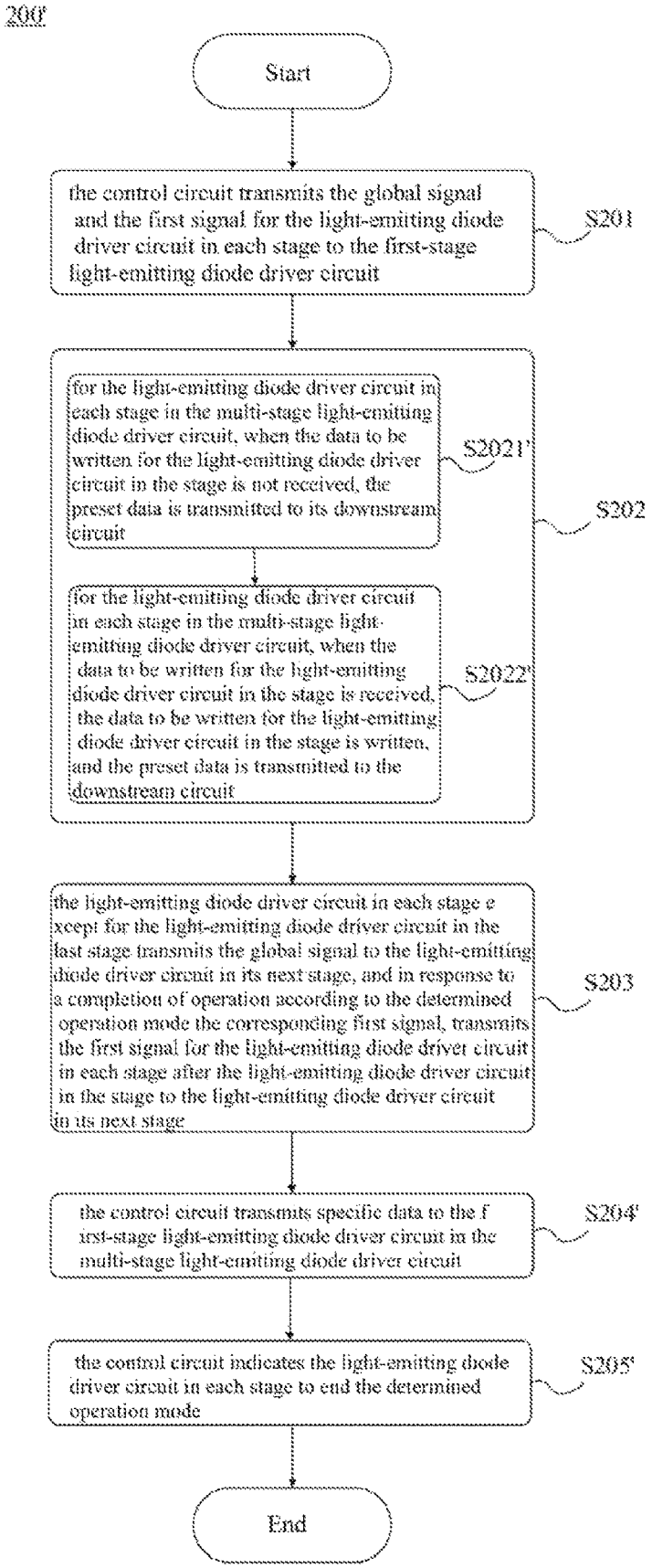
FIG. 2B is a specific flowchart of a method in which the display driver system performs a write operation according to the embodiments of the present disclosure.

The specific implementation of the method 200 will be described below by taking the display driver system performing the write operation as an example. FIG. 2B is a specific flowchart of a method 200' in which the display driver system performs the write operation according to the embodiments of the present disclosure. The method 200' includes steps S201 to S203 shown in FIG. 2A.

In step S201, the command in the global signal may be referred to as a global instruction or a global command. According to one example of the present disclosure, the command in the global signal may be a write command (may be abbreviated as WR CMD), and the operation mode corresponding to the command is the write mode. Correspondingly, the LED driver circuit in each stage may determine the operation mode corresponding to the command as the write mode according to the global signal.

In addition, the global signal in step S201 may also include data related to Clock Training (CT) and Command Transmission Indication (Command Start, CS). In this case, the data related to Clock Training (CT), the Command Transmission Indication (CS), and the command may be transmitted in sequence. In addition, in the example where the command in the global signal is the Write Command (WR CMD), the global signal may include the data (CT) related to the Clock Training, the Command Transmission Indication (CS), and the Write Command (WR CMD), and the data related to the Clock Training (CT), the Command Transmission Indication (CS) and the Write Command (WR CMD) may be transmitted in sequence.

During the period when an upstream circuit transmits the CT in the global signal to a LED driver circuit, the LED driver circuit may be in a state of waiting for CT and in a state of bypass. As described above, the LED driver circuit being in the state of bypass means that the LED driver circuit does not process the received signals but transmits them to its downstream circuit. In addition, during the period when the upstream circuit transmits the CS and the WR CMD in the global signal to the LED driver circuit, the LED driver circuit may write the WR CMD and be in the state of bypass. The LED driver circuit in the last stage may feed the received global signal back to the control circuit.

For the first-stage LED driver circuit in the multi-stage LED driver circuit, its upstream circuit is the control circuit, and its downstream circuit is the LED driver circuit in its next stage (i.e., the second stage); for LED driver circuit in each stage in the multi-stage LED driver circuit, except for the first-stage LED driver circuit and the LED driver circuit in the last stage, the upstream circuit is the LED driver circuit in its previous stage, and the downstream circuit is the LED driver circuit in its next stage; for the LED driver circuit in the last stage in the multi-stage LED driver circuit, its upstream circuit is the LED driver circuit in its previous stage, and its downstream circuit is the control circuit.

In other words, during the period when the control circuit transmits the CT in the global signal to the first-stage LED driver circuit, the first-stage LED driver circuit may be in a state of waiting for CT and in a state of bypass. During the period when the control circuit transmits the CS and the WR CMD in the global signal to the first-stage LED driver circuit, the first-stage LED driver circuit may write the WR CMD and be in the state of bypass. In addition, during the period when the LED driver circuit in a stage transmits the CT in the global signal to LED driver circuit in its next stage, the LED driver circuit in its next stage may be in the state of waiting for CT and in the state of bypass. During the period when the LED driver circuit in the stage transmits the CS and the WR CMD in the global signal to the LED driver circuit in its next stage, the LED driver circuit in its next stage may write the WR CMD and be in the state of bypass. In other words, the LED driver circuit in each stage except for the first-stage LED driver circuit receives the CT, the CS, and the WR CMD from the LED driver circuit in its previous stage through the state of bypass of the LED driver circuit in its previous stage.

In addition, in the example where the command in the global signal is the write command, the first signal for the LED driver circuit in each stage in step S201 may include at least data to be written (DATA) for the LED driver circuit in the stage. In addition, the first signal for the LED driver circuit in each stage may also include data related to Clock Training (CT) and/or Data Transmission Command (Data Start, DS). In this case, the data related to Clock Training (CT), the Data Transmission Command (DS), and the data to be written (DATA) may be sequentially transmitted.

In addition, according to one example of the present disclosure, in step S202, for the LED driver circuit in each stage in the multi-stage LED driver circuit, operating according to the determined operation mode and the corresponding first signal may include two sub-steps, namely step S2021' and step S2022', respectively. Specifically, in step S2021', when the data to be written for the LED driver circuit in the stage is not received, preset data is transmitted to its downstream circuit; and in step S2022', when the data to be written for the LED driver circuit in the stage is received, the data to be written for the LED driver circuit in the stage is written, and the preset data is transmitted to the downstream circuit; wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage.

In addition, in step S203, in response to the completion of operation according to the determined operation mode and the corresponding first signal, the LED driver circuit in each stage except for the LED driver circuit in the last stage transmits the first signal for the LED driver circuit in each stage after the LED driver circuit in the stage to the LED driver circuit in its next stage. For example, in response to the completion of operation according to the determined operation mode and the corresponding first signal, the LED driver circuit in each stage except for the LED driver circuit in the last stage may enter a state of waiting for the control circuit to indicate to end the determined operation mode (for example, waiting for the control circuit to change the level of the synchronization signal), and be in the state of bypass. When the LED driver circuit in the stage is in the state of bypass, the LED driver circuit in the stage may not process the received first signal for the LED driver circuit in each stage after the LED driver circuit in the stage, but transmit the first signal for the LED driver circuit in each stage after the LED driver circuit in the stage to the LED driver circuit in its next stage.

Specifically, during the period when an upstream circuit transmits, to a LED driver circuit in a stage, the CT in the first signal for the LED driver circuit in the stage, the LED driver circuit may be in a state of waiting for DS, and because the LED driver circuit does not receive the data to be written (DATA) for the LED driver circuit in the stage, the LED driver circuit outputs preset data to its downstream circuit. During the period when the upstream circuit transmits, to the LED driver circuit, the DS and the data to be written (DATA) in the first signal for the LED driver circuit in the stage, the LED driver circuit may write the data to be written and continue to output preset data to its downstream circuit. After writing the data to be written, the LED driver circuit in the stage enters the state of bypass, i.e., the LED driver circuit transmits, to the LED driver circuit in its next stage, the first signal for the LED driver circuit in each stage after the LED driver circuit in the stage received from the upstream circuit. The upstream circuit and the downstream circuit of the LED driver circuit have been explained above, and will not be repeated herein.

In other words, during the period when the control circuit transmits the CT in the first signal for the first-stage LED driver circuit to the first-stage LED driver circuit, the first-stage LED driver circuit may be in a state of waiting for DS, and because the first-stage LED driver circuit does not receive the data to be written (DATA) for the first-stage LED driver circuit, the first-stage LED driver circuit outputs preset data to the LED driver circuit in its next stage; during the period when the control circuit transmits the DS and the data to be written (DATA) in the first signal for the first-stage LED driver circuit to the first-stage LED driver circuit, the first-stage LED driver circuit may write the data to be written, and continue to output the preset data to the LED driver circuit in its next stage.

In addition, for the LED driver circuit in each stage except for the first-stage LED driver circuit and the LED driver circuit in the last stage in the multi-stage LED driver circuit, during the period when the LED driver circuit in its previous stage transmits, to the LED driver circuit in the stage, the preset data and the CT in the first signal for the LED driver circuit in the stage, the LED driver circuit in the stage may be in the state of waiting for DS, and because the LED driver circuit in the stage does not receive the data to be written (DATA) for the LED driver circuit in the stage, the LED driver circuit in the stage outputs the preset data to the LED driver circuit in its next stage; during the period when the LED driver circuit in its previous stage transmits, to the LED driver circuit in the stage, the DS and the data to be written (DATA) in the first signal for the LED driver circuit in the stage, the LED driver circuit in the stage may write the data to be written, and continue to output the preset data to the LED driver circuit in its next stage.

In addition, for the LED driver circuit in the last stage in the multi-stage LED driver circuit, during the period when the LED driver circuit in its previous stage transmits, to the LED driver circuit in the last stage, the preset data and the CT in the first signal for the LED driver circuit in the last stage, the LED driver circuit in the last stage may be in the state of waiting for DS, and because the LED driver circuit in the last stage does not receive the data to be written (DATA) for the LED driver circuit in the last stage, the LED driver circuit in the last stage outputs the preset data to the control circuit; during the period when the LED driver circuit in its previous stage transmits, to the LED driver circuit in the last stage, the DS and the data to be written (DATA) in the first signal for the LED driver circuit in the last stage, the LED driver circuit in the last stage may write the data to be written, and continue to output the preset data to the control circuit.

In addition, after the control circuit transmits the global signal and the first signal for the LED driver circuit in each stage to the first-stage LED driver circuit in the multi-stage LED driver circuit, the method 200' shown in FIG. 2B may further include step S204'. In step S204', the control circuit transmits specific data to the first-stage LED driver circuit in the multi-stage LED driver circuit. According to the above description, after the LED driver circuit in each stage writes the data to be written, the LED driver circuit in each stage is in the state of bypass, therefore, the LED driver circuit in each stage may transmit the specific data to its downstream circuit. Specifically, the LED driver circuit in each stage except for the LED driver circuit in the last stage may transmit the specific data to the LED driver circuit in its next stage; and the LED driver circuit in the last stage may feed the specific data back to the control circuit.

In addition, after step S204', the method 200' shown in FIG. 2B may further include step S205'. In step S205', the control circuit indicates the LED driver circuit in each stage to end the determined operation mode. For example, the control circuit may change a level of a synchronization signal (for example, from a high level to a low level, or from a low level to a high level) transmitted by the control circuit to the LED driver circuit in each stage. Correspondingly, the LED driver circuit in each stage may end the current operation mode after detecting the change in the level of the synchronization signal.

In addition, the preset data mentioned above may be data whose value is a preset value. The preset value may be 0 or 1, for example. The specific data mentioned above may be data related to Clock Training (CT), for example. The CT may be used as dummy data and the value of the CT may be defined as being not equal to the values of the DS and the CS. In addition, the CT and/or the DS may be used as a header of a data packet, and the data to be written (DATA) may be used as a data part of the data packet. In addition, the data to be written (DATA) may be display data (for example, grayscale data) or a set value.

In the following, taking the display driver system including one control circuit and a three-stage LED driver circuit and the display driver system performing a write operation as an example, the specific flow of the method 200' will be described again in combination with FIG. 3 and FIG. 4.

Figure 3:
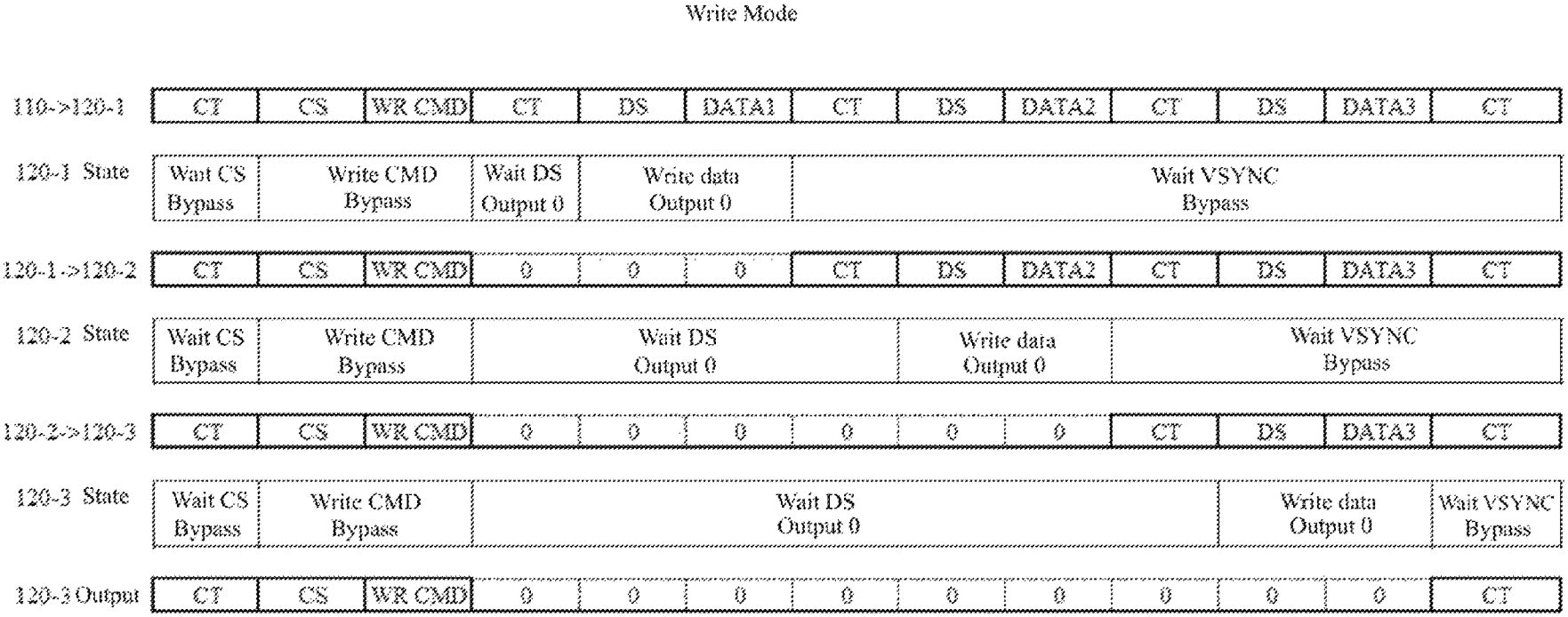
FIG. 3 shows a schematic diagram of a process in which the display driver system performs a write operation.
Figure 4:
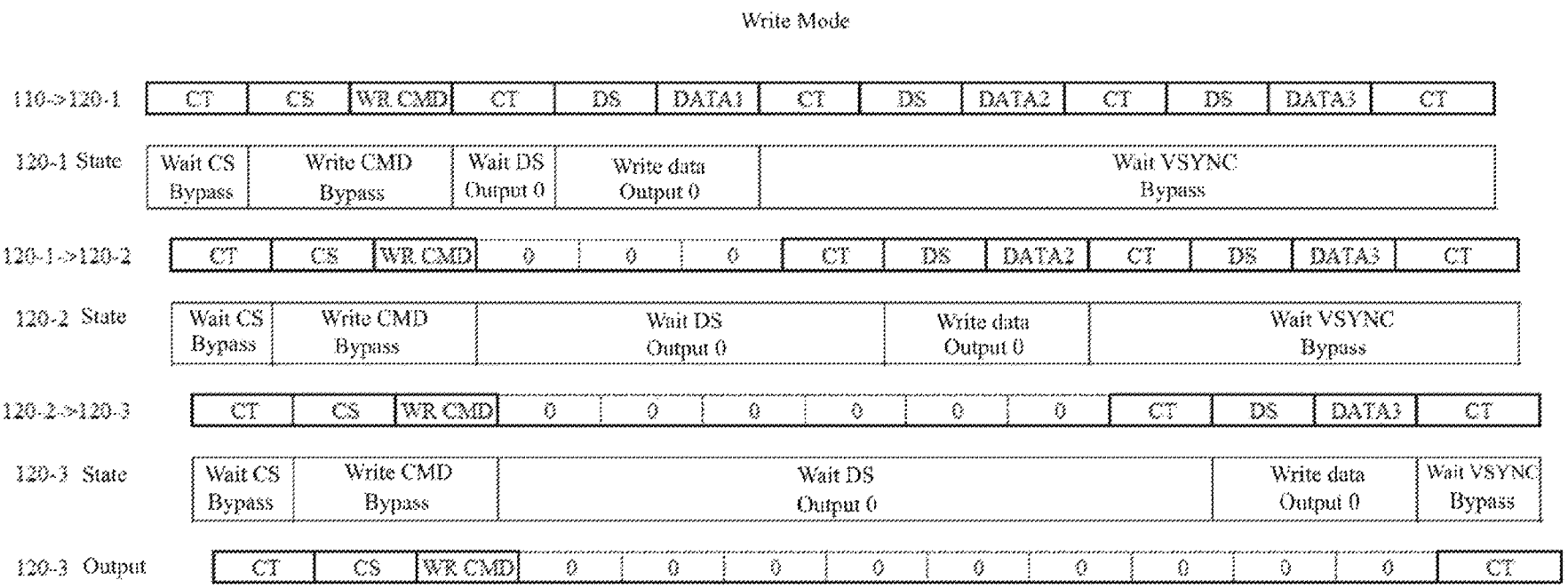
FIG. 4 shows a schematic diagram of another process in which the display driver system performs a write operation.

FIG. 3 shows a schematic diagram of the process in which the display driver system performs the write operation. As shown in FIG. 3, the control circuit sequentially transmits the global signal, the first signal for the LED driver circuit in each stage, and specific data to the first-stage LED driver circuit. The global signal includes data related to Clock Training (CT), Command Transmission Indication (CS), and Write Command (WR CMD). The first signal for the first-stage LED driver circuit includes data related to Clock Training (CT), Data Transmission Command (DS), and the data to be written (DATA1) to be written by the first-stage LED driver circuit; the first signal for the second-stage LED driver circuit includes data related to Clock Training (CT), Data Transmission Command (DS), and the data to be written (DATA2) to be written by the second-stage LED driver circuit; and the first signal for the third-stage LED driver circuit includes data related to Clock Training (CT), Data Transmission Command (DS), and the data to be written (DATA3) to be written by the third-stage LED driver circuit. The specific data is the data related to Clock Training (CT).

In addition, as shown in FIG. 3, during the period when the control circuit transmits the CT in the global signal to the first-stage LED driver circuit, the first-stage LED driver circuit may be in a state of waiting for CT and in a state of bypass. During the period when the control circuit transmits the CS and the WR CMD in the global signal to the first-stage LED driver circuit, the first-stage LED driver circuit may write the WR CMD and be in the state of bypass. In addition, during the period when the first-stage LED driver circuit transmits the CT in the global signal to the second-stage LED driver circuit, the second-stage LED driver circuit may be in the state of waiting for CT and in the state of bypass. During the period when the first-stage LED driver circuit transmits the CS and the WR CMD in the global signal to the second-stage LED driver circuit, the second-stage LED driver circuit may write the WR CMD and be in the state of bypass. In addition, during the period when the second-stage LED driver circuit transmits the CT in the global signal to the third-stage LED driver circuit, the third-stage LED driver circuit may be in the state of waiting for CT and in the state of bypass. During the period when the second-stage LED driver circuit transmits the CS and the WR CMD in the global signal to the third-stage LED driver circuit, the third-stage LED driver circuit may write the WR CMD and be in the state of bypass. The third-stage LED driver circuit may feed the received global signal back to the control circuit.

In addition, during the period when the control circuit transmits the CT in the first signal for the first-stage LED driver circuit to the first-stage LED driver circuit, the first-stage LED driver circuit may be in a state of waiting for DS, and because the first-stage LED driver circuit does not receive the data to be written (DATA1) for the LED driver circuit in the stage, the first-stage LED driver circuit outputs 0 to the second-stage LED driver circuit; during the period when the control circuit transmits the DS and the data to be written (DATA1) in the first signal for the first-stage LED driver circuit to the first-stage LED driver circuit, the first-stage LED driver circuit may write the data to be written (DATA1), and continue to output 0 to the second-stage LED driver circuit. After that, the first-stage LED driver circuit waits for the control circuit to change the level of the synchronization signal and is in the state of bypass. Therefore, the first-stage LED driver circuit transmits the first signal for the second-stage LED driver circuit and the first signal for the third-stage LED driver circuit received from the control circuit to the second-stage LED driver circuit.

During the period when the first-stage LED driver circuit transmits 0 and the CT in the first signal for of the second-stage LED driver circuit to the second-stage LED driver circuit, the second-stage LED driver circuit may be in the state of waiting for DS, and because the second-stage LED driver circuit does not receive the data to be written (DATA2) for the second-stage LED driver circuit, the second-stage LED driver circuit outputs 0 to the third-stage LED driver circuit; during the period when the first-stage LED driver circuit transmits the DS in the first signal for second-stage LED driver circuit and the data to be written (DATA2) to the second-stage LED driver circuit, the second-stage LED driver circuit may write the data to be written (DATA2), and continue to output 0 to the third-stage LED driver circuit. After that, the second-stage LED driver circuit waits for the control circuit to change the level of the synchronization signal and is in the state of bypass. Therefore, the second-stage LED driver circuit transmits the first signal for the third-stage LED driver circuit received from the first-stage LED driver circuit to the third-stage LED driver circuit.

During the period when the second-stage LED driver circuit transmits 0 and the CT in the first signal for third-stage LED driver circuit to the third-stage LED driver circuit, the third-stage LED driver circuit may be in the state of waiting for DS, and because the third-stage LED driver circuit does not receive the data to be written (DATA3) for the third-stage LED driver circuit, the third-stage LED driver circuit outputs 0 to the control circuit; during the period when the second-stage LED driver circuit transmits the DS in the first signal for the third-stage LED driver circuit and the data to be written (DATA3) to the third-stage LED driver circuit, the third-stage LED driver circuit may write the data to be written (DATA3), and continue to output 0 to the control circuit.

After writing the data to be written, the LED driver circuit in each stage is in the state of bypass. Therefore, the first-stage LED driver circuit may transmit the CT received from the control circuit to the second-stage LED driver circuit, and the second-stage LED driver circuit may transmit the CT received from the first-stage LED driver circuit to the third-stage LED driver circuit, and the third-stage LED driver circuit may feed the CT received from the second-stage LED driver circuit back to the control circuit.

After that, the control circuit may change the level of the synchronization signal (not shown in the figure) that it transmits to the LED driver circuit in each stage, to indicate the LED driver circuit in each stage to end the write mode.

Through the above method, the data to be written may be written into the LED driver circuit in each stage in sequence until the level of the synchronization signal changes, so that the LED driver circuit corresponding to data may be determined without requiring determination mechanisms such as employing additional pins or employing chip selection signals.

It should be understood that the above example is based on ideally aligned timing, that is, there is no delay in signal transmission process. When there is a delay in the signal transmission process, signals may be delayed stage by stage between the control circuit and the LED driver circuit in each stage and between the LED driver circuits in adjacent stages. FIG. 4 shows a schematic diagram of another process in which the display driver system performs the write operation. As shown in FIG. 4, the time when the third-stage LED driver circuit receives the global signal from the second-stage LED driver circuit is later than the time when the second-stage LED driver circuit receives the global signal from the first-stage LED driver circuit, and the time when the second-stage LED driver circuit receives the global signal from the first-stage LED driver circuit is later than the time when the first-stage LED driver circuit receives the global signal from the control circuit. However, this delay does not affect the operations of the control circuit and the LED driver circuit in each stage described above.

Figure 2C:
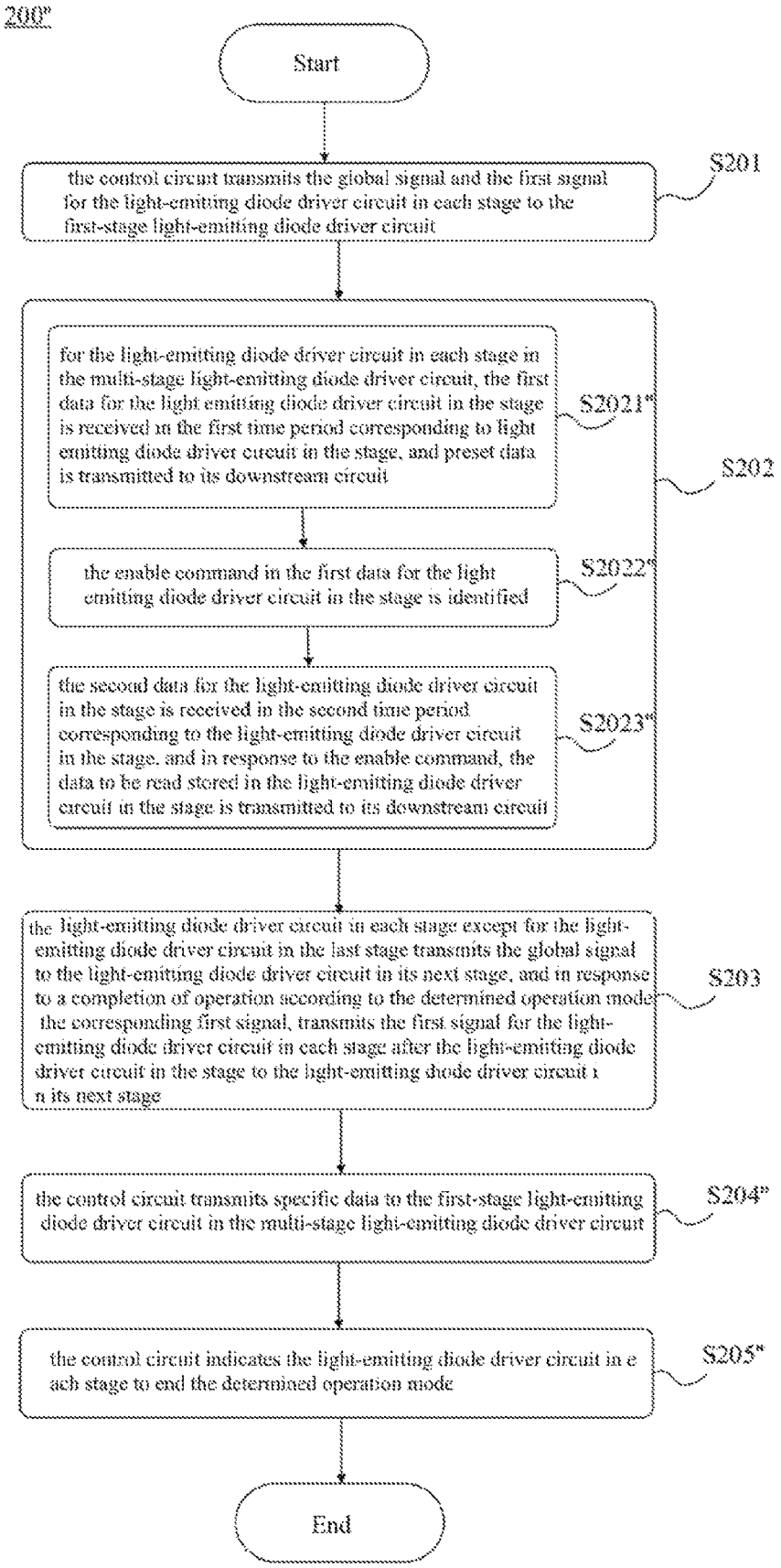
FIG. 2C is a specific flowchart of a method in which the display driver system performs a read operation according to the embodiments of the present disclosure.

Next, the specific implementation of the method 200 will be described by taking the display driver system performing the read operation as an example. FIG. 2C is a specific flowchart of a method 200" for the display driver system to perform the read operation according to the embodiments of the present disclosure. The method 200" includes steps S201 to S203 shown in FIG. 2A.

In step S201, the command in the global signal may be a Read Command (RD CMD), and the operation mode corresponding to the command is a read mode. Correspondingly, the LED driver circuit in each stage may determine the operation mode corresponding to the command as the read mode according to the global signal.

In addition, the global signal in step S201 may also include data related to Clock Training (CT) and Command Transmission Indication (Command Start, CS). In this case, the data related to Clock Training (CT), the Command Transmission Indication (CS), and the command may be transmitted in sequence. In addition, in the example where the command in the global signal is a Read Command (RD CMD), the global signal may include data related to the Clock Training (CT), Command Transmission Indication (CS), and Read Command (RD CMD), and the data related to the Clock Training (CT), the Command Transmission Indication (CS) and the Read Command (RD CMD) may be transmitted in sequence.

During the period when an upstream circuit transmits the CT in the global signal to a LED driver circuit, the LED driver circuit may be in a state of waiting for CT and in a state of bypass. In addition, during the period when the upstream circuit transmits the CS and RD CMD in the global signal to the LED driver circuit, the LED driver circuit may write the RD CMD and be in the state of bypass. The LED driver circuit in the last stage may feed the received global signal back to the control circuit. The upstream circuit and the downstream circuit of the LED driver circuit have been explained above, and will not be repeated here.

In other words, during the period when the control circuit transmits the CT in the global signal to the first-stage LED driver circuit, the first-stage LED driver circuit may be in a state of waiting for CT and in a state of bypass. During the period when the control circuit transmits the CS and RD CMD in the global signal to the first-stage LED driver circuit, the first-stage LED driver circuit may write RD CMD and be in the state of bypass. In addition, during the period when the LED driver circuit in a stage transmits the CT in the global signal to the LED driver circuit in its next stage, the LED driver circuit in its next stage may be in the state of waiting for CT and in the state of bypass. During the period when the LED driver circuit in the stage transmits the CS and the RD CMD in the global signal to the LED driver circuit in its next stage, the LED driver circuit in its next stage may write the RD CMD and be in the state of bypass. The LED driver circuit in the last stage may feed the received global signal back to the control circuit.

In addition, in the example where the command in the global signal is a read command, the first signal for the LED driver circuit in each stage in step S201 includes first data and second data for the LED driver circuit in the stage. The first data includes an enable command, for example an Output Enable (OE) command. The first data may also include data related to Clock Training (CT). In this case, data related to Clock Training (CT) and Output Enable (OE) command may be transmitted in sequence, or a part of CT, Output Enable (OE) command and another part of CT may be transmitted in sequence. In addition, the second data may include data related to Clock Training (CT).

In this example, the control circuit transmitting the first signal for the LED driver circuit in each stage to the first-stage LED driver circuit in the multi-stage LED driver circuit may include: the control circuit transmitting the first signal for the LED driver circuit in the i-th stage in a preset time period corresponding to the LED driver circuit in the i-th stage, wherein the preset time period includes a first time period (for example, T1) and a second time period (for example, T2), the control circuit transmitting the first data for the LED driver circuit in the i-th stage in the first time period and transmitting the second data for the LED driver circuit in the i-th stage in the second time period, wherein, the multi-stage LED driver circuit is an N-stage LED driver circuit, N is an integer greater than or equal to 3, and i is an integer greater than or equal to 1 and less than or equal to N.

According to one example of the present disclosure, the first time period and the second time period for a certain LED driver circuit may have a same duration or different durations. In addition, the first time periods for different LED driver circuits may have a same duration or different durations. In addition, the second time periods for different LED driver circuits may have a same duration or different durations.

Taking the first time period and the second time period for each LED driver circuit having the same duration as an example, how the control circuit transmits the first signal for the LED driver circuit in each stage to the first-stage LED driver circuit in the multi-stage LED driver circuit will be described. For example, 2N time periods with the same duration may be preset, and the start time of the 2N time periods may be after the transmission of the global signal is completed, and the 2N time periods are continuous in time. The first time period of the 2N time periods may be regarded as the first time period for the first-stage LED driver circuit, the second time period of the 2N time periods may be regarded as the second time period for the first-stage LED driver circuit, the third time period of the 2N time periods may be regarded as the first time period for the second-stage LED driver circuit, the fourth time period of the 2N time periods may be regarded as the second time period for the second-stage LED driver circuit, . . . , the (2N−1)-th time period of the 2N time periods may be regarded as the first time period for the LED driver circuit in the N-th stage, and the 2N-th time period of the 2N time periods may be regarded as the second time period for the LED driver circuit in the N-th stage. The control circuit may transmit the first data in the first signal for the first-stage LED driver circuit in the first time period, transmit the second data in the first signal for the first-stage LED driver circuit in the second time period, transmit the first data in the first signal for the second-stage LED driver circuit in the third time period, transmit the second data in the first signal for the second-stage LED driver circuit in the fourth time period, . . . , transmit the first data in the first signal for the LED driver circuit in the N-th stage in the (2N−1)-th time period, and transmit the second data in the first signal for the LED driver circuit in the N-th stage in the 2N-th time period.

In addition, according to one example of the present disclosure, in step S202, for the LED driver circuit in each stage in the multi-stage LED driver circuit, operating according to the determined operation mode and the corresponding first signal may include three sub-steps, which are respectively step S2021", step S2022" and step S2023". Specifically, in step S2021", the first data for the LED driver circuit in the stage is received in the first time period corresponding to LED driver circuit in the stage, and preset data is transmitted to its downstream circuit; in step S2022", the enable command in the first data for the LED driver circuit in the stage is identified; in step S2023", the second data for the LED driver circuit in the stage is received in the second time period corresponding to the LED driver circuit in the stage, and in response to the enable command, the data to be read stored in the LED driver circuit in the stage is transmitted to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage.

In addition, in step S203, the LED driver circuit in each stage except for the LED driver circuit in the last stage, in response to a completion of operation according to the determined operation mode and the corresponding first signal, transmits the first signal for the LED driver circuit in each stage after the LED driver circuit in the stage to the LED driver circuit in its next stage. For example, in response to the completion of operation according to the determined operation mode and the corresponding first signal, the LED driver circuit in each stage except for the LED driver circuit in the last stage, may enter a state of waiting for the control circuit to indicate to end the determined operation mode (for example, waiting for the control circuit to change a level of a synchronization signal), and be in the state of bypass. When being in the state of bypass, the LED driver circuit in the stage may not process the received first signal for the LED driver circuit in each stage after the LED driver circuit in the stage, but may transmit the first signal for the LED driver circuit in each stage after the LED driver circuit in the stage to the LED driver circuit in its next stage.

Specifically, during the period when an upstream circuit transmits the first data (for example, CT, OE) for a LED driver circuit in a stage to the LED driver circuit in the stage in the first time period corresponding to the LED driver circuit in the stage, the LED driver circuit in the stage may receive the first data for the LED driver circuit in the stage, be in a state of waiting for the enable (for example, OE) command, and output preset data to its downstream circuit. The LED driver circuit in the stage may identify the enable command in the first data for the LED driver circuit in the stage. During the period when the upstream circuit transmits the second data (for example, CT) for the LED driver circuit in the stage to the LED driver circuit in the stage in the second time period corresponding to the LED driver circuit in the stage, the LED driver circuit in the stage may receive the second data for the LED driver circuit in the stage, be in the read mode, and transmit the data to be read stored in the LED driver circuit in the stage to its downstream circuit. After outputting the data to be read, the LED driver circuit in the stage enters the state of bypass, that is, the LED driver circuit in the stage transmits, to the LED driver circuit in its next stage, the first signal for the LED driver circuit in each stage after the LED driver circuit in the stage received from the upstream circuit.

In other words, during the period when the control circuit transmits the first data (for example, CT, OE) for the LED driver circuit in the first-stage to the first-stage LED driver circuit in the first time period corresponding to the first-stage LED driver circuit, the first-stage LED driver circuit may receive the first data for the first-stage LED driver circuit, be in a state of waiting for the enable (for example, OE) command, and output preset data to the LED driver circuit in its next stage. The first-stage LED driver circuit may identify the enable command in the first data for the first-stage LED driver circuit. During the period when the control circuit transmits the second data (for example, CT) for the first-stage LED driver circuit to the first-stage LED driver circuit in the second time period corresponding to the first-stage LED driver circuit, the first-stage LED driver circuit may receive the second data for the first-stage LED driver circuit, be in the read mode, and transmit the data to be read stored in the first-stage LED driver circuit to the LED driver circuit in the next stage (i.e., second stage).

In addition, for the LED driver circuit in each stage except for the first-stage LED driver circuit and the LED driver circuit in the last stage in the multi-stage LED driver circuit, during the period when the LED driver circuit in a stage (e.g., i-th stage) transmits the first data (for example, CT, OE) for the LED driver circuit in its next stage (e.g. (i+1)-th stage) to the LED driver circuit in its next stage (e.g. (i+1)-th stage) in the first time period corresponding to the LED driver circuit in its next stage (e.g. (i+1)-th stage). The LED driver circuit in its next stage (e.g. (i+1)-th stage) may receive the first data for the LED driver circuit in the stage (e.g. (i+1)-th stage), be in the state of waiting for the enable (for example, OE) command, and output preset data to the LED driver circuit in its next stage (e.g., (i+2)-th stage). The LED driver circuit in the stage may identify the enable command in the first data for the LED driver circuit in the stage. During the period when the LED driver circuit in the stage (e.g., i-th stage) transmits the second data (for example, CT) for the LED driver circuit in its next stage (e.g. (i+1)-th stage) to the LED driver circuit in its next stage (e.g. (i+1)-th stage) in the second time period corresponding to the LED driver circuit in its next stage (e.g. (i+1)-th stage). The LED driver circuit in its next stage (e.g. (i+1)-th stage) may receive the second data for the LED driver circuit in its next stage (e.g. (i+1)-th stage), be in the read mode, and transmit the data to be read stored in the LED driver circuit in the stage to the LED driver circuit in its next stage (e.g. (i+2)-th stage).

In addition, for the LED driver circuit in the last stage in the multi-stage LED driver circuit, during the period when the LED driver circuit in its previous stage transmits the first data (for example, CT, OE) for the LED driver circuit in the last stage to the LED driver circuit in the last stage in the first time period corresponding to the LED driver circuit in the last stage, the LED driver circuit in the last stage may receive the first data for the LED driver circuit in the last stage, be in the state of waiting for the enable (for example, OE) command, and output preset data to the control circuit. The LED driver circuit in the last stage may identify the enable command in the first data for the LED driver circuit in the last stage. During the period when the LED driver circuit in its previous stage transmits the second data (for example, CT) for the LED driver circuit in the last stage to the LED driver circuit in the last stage in the second time period corresponding to the LED driver circuit in the last stage, the LED driver circuit in the last stage may receive the second data for the LED driver circuit in the last stage, be in the read mode, and transmit the data to be read stored in the LED driver circuit in the last stage to the control circuit.

In addition, before step S202, the method 200" may further include the following operations: for the LED driver circuit in each stage except for the first-stage LED driver circuit in the multi-stage LED driver circuit, in one or more preset time periods before the first time period corresponding to the LED driver circuit in the stage, transmitting the data received from the LED driver circuit in its previous stage to its downstream circuit. For example, for the LED driver circuit in each stage except for the first-stage LED driver circuit in the multi-stage LED driver circuit, in the first time period included in one or more preset time periods before the first time period corresponding to the LED driver circuit in the stage, preset data is received from the LED driver circuit in its previous stage, and the preset data is transmitted to its downstream circuit, and in the second time period included in one or more preset time periods, the data to be read which is from the LED driver circuit in its previous stage is received from the LED driver circuit in its previous stage, and the data to be read which is from the LED driver circuit in its previous stage is transmitted to its downstream circuit.

In addition, after the control circuit transmits the global signal and the first signal for the LED driver circuit in each stage to the first-stage LED driver circuit in the multi-stage LED driver circuit, the method 200" may further include step S204". In step S204", the control circuit transmits specific data to the first-stage LED driver circuit in the multi-stage LED driver circuit. According to the above description, after outputting the data to be read, the LED driver circuit in each stage is in the state of bypass, therefore, the LED driver circuit in each stage may transmit specific data to its downstream circuit. Specifically, the LED driver circuit in each stage except for the LED driver circuit in the last stage may transmit the specific data to the LED driver circuit in its next stage, and the LED driver circuit in the last stage may feed the specific data back to the control circuit.

In addition, after step S204", the method 200" may further include step S205". In step S205", the control circuit indicates the LED driver circuit in each stage to end the determined operation mode. For example, the control circuit may change a level of a synchronization signal (for example, from a high level to a low level, or from a low level to a high level) transmitted by the control circuit to the LED driver circuit in each stage. Correspondingly, the LED driver circuit in each stage may end the current operation mode after detecting the change in the level of the synchronization signal.

In addition, the preset data mentioned above may be data whose value is a preset value. The preset value may be 0 or 1, for example. The specific data mentioned above may be data related to Clock Training (CT), for example. In addition, the CT and/or the OE may be used as a header of the data packet. In addition, the data to be read may be display data (for example, grayscale data) or a set value.

In the following, taking the display driver system including one control circuit and a three-stage LED driver circuit and the display driver system performing the read operation as an example, the specific flow of the method 200" will be described again in combination with FIG. 5.

Figure 5:
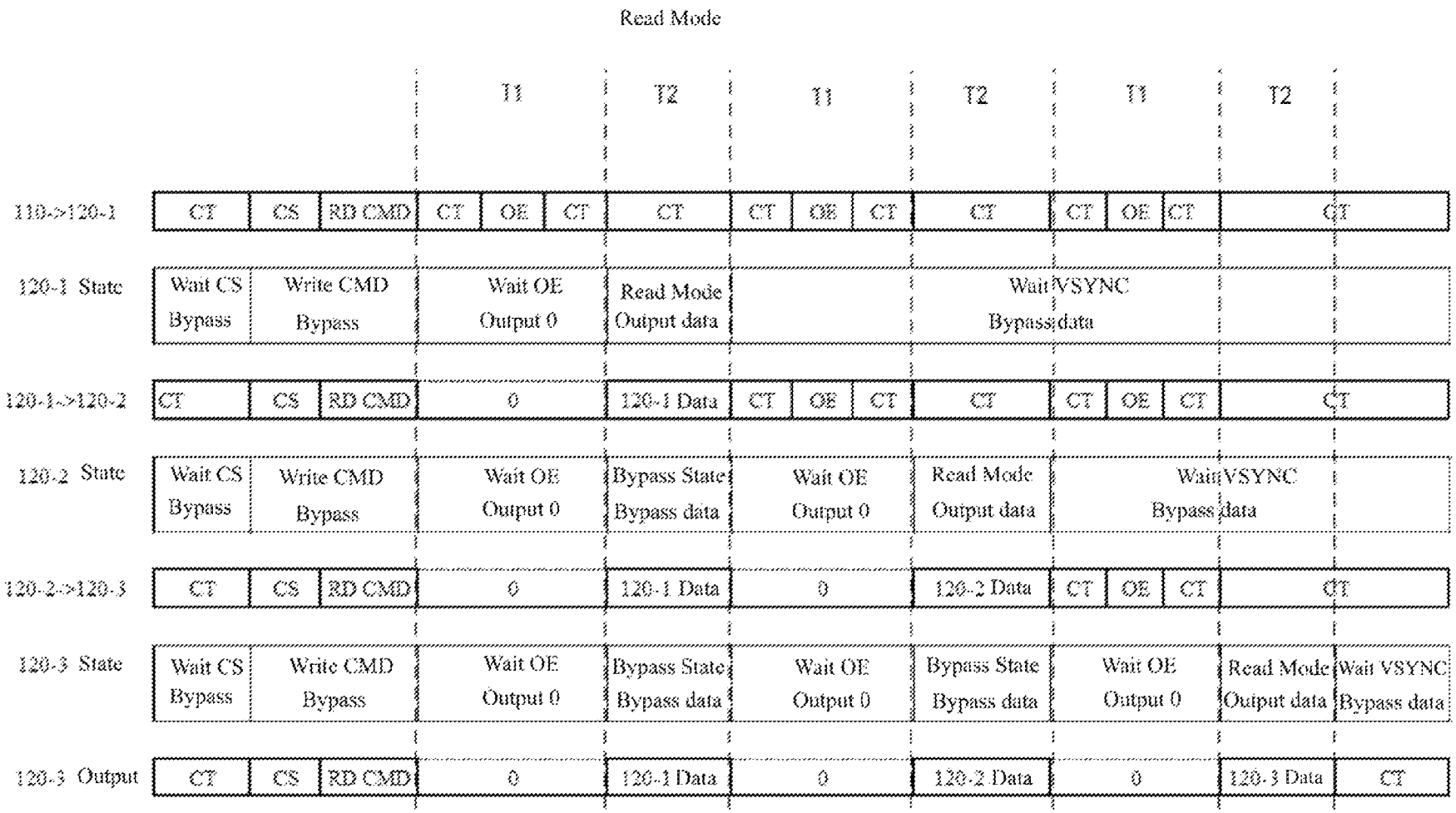
FIG. 5 shows a schematic diagram of a process in which the display driver system performs a read operation.

FIG. 5 shows a schematic diagram of the process in which the display driver system performs the read operation. As shown in FIG. 5, the control circuit sequentially transmits the global signal, the first signal for the LED driver circuit in each stage, and specific data to the first-stage LED driver circuit. The global signal includes data related to Clock Training (CT), Command Transmission Indication (CS), and Read Command (RD CMD). The first signal for the first-stage LED driver circuit may include first data (CT, OE) to be transmitted in the first time period (T1) corresponding to the first-stage LED driver circuit and second data (CT) to be transmitted in the second time period (T2) corresponding to the first-stage LED driver circuit. The first signal for the second-stage LED driver circuit may include first data (CT, OE) to be transmitted in the first time period (T1) corresponding to the second-stage LED driver circuit and second data (CT) to be transmitted in the second time period (T2) corresponding to the second-stage LED driver circuit. The first signal for the third-stage LED driver circuit may include the first data (CT, OE) to be transmitted in the first time period (T1) corresponding to the third-stage LED driver circuit and second data (CT) to be transmitted in the second time period (T2) corresponding to the third-stage LED driver circuit. The specific data is the data related to Clock Training (CT).

In addition, as shown in FIG. 5, during the period when the control circuit transmits the CT in the global signal to the first-stage LED driver circuit, the first-stage LED driver circuit may be in a state of waiting for CT and in a state of bypass. During the period when the control circuit transmits the CS and the RD CMD in the global signal to the first-stage LED driver circuit, the first-stage LED driver circuit may write the RD CMD and be in the state of bypass. In addition, during the period when the first-stage LED driver circuit transmits the CT in the global signal to the second-stage LED driver circuit, the second-stage LED driver circuit may be in the state of waiting for CT and in the state of bypass. During the period when the first-stage LED driver circuit transmits the CS and the RD CMD in the global signal to the second-stage LED driver circuit, the second-stage LED driver circuit may write the RD CMD and be in the state of bypass. In addition, during the period when the second-stage LED driver circuit transmits the CT in the global signal to the third-stage LED driver circuit, the third-stage LED driver circuit may be in the state of waiting for CT and in the state of bypass. During the period when the second-stage LED driver circuit transmits the CS and the RD CMD in the global signal to the third-stage LED driver circuit, the third-stage LED driver circuit may write the RD CMD and be in the state of bypass. The third-stage LED driver circuit may feed the received global signal back to the control circuit.

In addition, during the period when the control circuit transmits the first data (for example, CT, OE) for the first-stage LED driver circuit in the first time period corresponding to the first-stage LED driver circuit to the first-stage LED driver circuit, the first-stage LED driver circuit may receive the first data for the first-stage LED driver circuit, be in a state of waiting for the enable (for example, OE) command, and output 0 to the second-stage LED driver circuit. The second-stage LED driver circuit may receive 0 from the first-stage LED driver circuit, be in the state of waiting for the enable (for example, OE) command, and output 0 to the third-stage LED driver circuit. The third-stage LED driver circuit may receive 0 from the second-stage LED driver circuit, be in the state of waiting for the enable (for example, OE) command, and output 0 to the control circuit.

In addition, during the period when the control circuit transmits the second data (for example, CT) for the first-stage LED driver circuit in second time period corresponding to the first-stage LED driver circuit to the first-stage LED driver circuit, the first-stage LED driver circuit may receive the second data for the first-stage LED driver circuit, be in the read mode, and transmit the data to be read stored in the first-stage LED driver circuit to the second-stage LED driver circuit. The second-stage LED driver circuit may receive, from the first-stage LED driver circuit, the data to be read which is from the first stage of LED driver circuit, be in the state of bypass, and transmit the data to be read which is from the first-stage LED driver circuit to the third-stage LED driver circuit. The third-stage LED driver circuit may receive, from the second-stage LED driver circuit, the data to be read which is from the first stage of LED driver circuit, be in the state of bypass, and transmit the data to be read which is from the first-stage LED driver circuit to the control circuit.

After the first-stage LED driver circuit outputs the data to be read, the first-stage LED driver circuit enters the state of bypass. Therefore, first signals for the second-stage and third-stage LED driver circuits after the first-stage LED driver circuit received from the control circuit are transmitted to the second-stage LED driver circuit. In the first time period corresponding to the second-stage LED driver circuit, the second-stage LED driver circuit performs the operations similar to those performed by the first-stage LED driver circuit in the first time period corresponding to the first-stage LED driver circuit, and the third-stage LED driver circuit performs the operations similar to those performed by the first-stage LED driver circuit in the first time period corresponding to the first-stage LED driver circuit. In the second time period corresponding to the second-stage LED driver circuit, the second-stage LED driver circuit performs the operations similar to those performed by the first-stage LED driver circuit in the second time period corresponding to the first-stage LED driver circuit, and the third-stage LED driver circuit performs the operations similar to those performed by the first-stage LED driver circuit in the second time period corresponding to the first-stage LED driver circuit.

After the second-stage LED driver circuit outputs the data to be read, the second-stage LED driver circuit enters the state of bypass. Therefore, the first signal for the third-stage LED driver circuit after the second-stage LED driver circuit received from the control circuit is transmitted to the third-stage LED driver circuit. In the first time period corresponding to the third-stage LED driver circuit, the third-stage LED driver circuit performs the operations similar to those performed by the first-stage LED driver circuit in the first time period corresponding to the first-stage LED driver circuit. In the second time period corresponding to the third-stage LED driver circuit, the third-stage LED driver circuit performs the operations similar to those performed by the first-stage LED driver circuit in the second time period corresponding to the first-stage LED driver circuit.

After outputting the data to be written, the LED driver circuit in each stage is in the state of bypass. Therefore, the first-stage LED driver circuit may transmit the CT received from the control circuit to the second-stage LED driver circuit, and the second-stage LED driver circuit may transmit the CT received from the first-stage LED driver circuit to the third-stage LED driver circuit, and the third-stage LED driver circuit may feed the CT received from the second-stage LED driver circuit back to the control circuit.

After that, the control circuit may change the level of the synchronization signal (not shown in the figure) that it transmits to the LED driver circuit in each stage, to indicate the LED driver circuit in each stage to end the read mode.

Through the above method, the data to be read may be read out from the LED driver circuit in each stage in sequence until the level of the synchronization signal changes, so that the LED driver circuit corresponding to the data may be determined without requiring determination mechanisms such as employing additional pins or employing chip selection signals.

It should be understood that the above example is based on ideally aligned timing, that is, there is no delay in signal transmission process. When there is a delay in the signal transmission process, signals may be delayed stage by stage between the control circuit and the LED driver circuit in each stage and between the LED driver circuits in adjacent stages (for example, the delay shown in FIG. 4). However, this delay does not affect the operations of the control circuit and the LED driver circuit in each stage described above.

In addition, in the present disclosure, for one write operation or one read operation, the control circuit may output CT (CT in the global signal) to identify the start of the operation, and output CT (specific data) to identify the end of the operation. That is to say, between the start and the end of the operation, all the data output by the control circuit may be regarded as a packet corresponding to the operation, which corresponds to a part of one horizontal display line on the display panel that is driven by the LED driver circuit in each stage. Before or after the operation, other data output by the control circuit is a packet corresponding to the same or different operation as the operation.

In addition, for one write operation or one read operation, during the transmission of the global signal, although the LED driver circuit in the last stage will transmit the received global signal to the control circuit, it is not after the control circuit receives the global signal fed back by the LED driver circuit in the last stage that the control circuit continues to output subsequent signals. In one complete write operation or read operation, the control circuit may determine the signals to be transmitted and how to transmit these signals. For example, the control circuit may determine to transmit a predetermined number of CTs, a predetermined number of CSs, a predetermined number of CMDs, etc., and the transmission sequence of these CTs, CSs, and CMDs.

Figure 6:
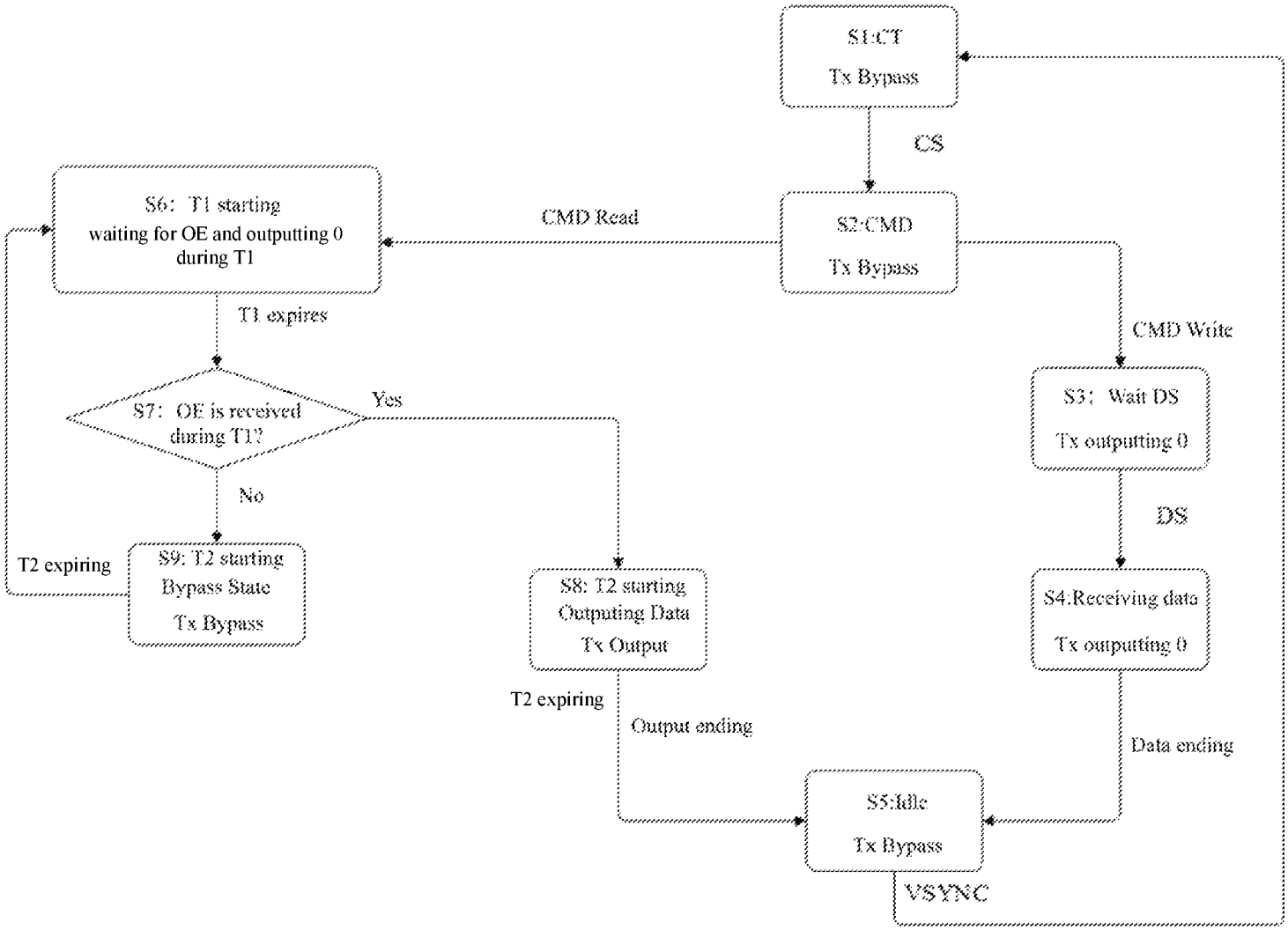
FIG. 6 shows a state diagram of the LED driver circuit in a write mode/read mode according to the embodiments of the present disclosure.

A state diagram of a LED driver circuit in the write mode/read mode will be described below in combination with FIG. 6. FIG. 6 shows the state diagram of the LED driver circuit in the write mode/read mode according to the embodiments of the present disclosure. Tx represents a transmitter (Tx) of the LED driver circuit.

As shown in FIG. 6, in step S1, the LED driver circuit receives CT from its upstream circuit, and the transmitter (Tx) is in the state of bypass. Then, by receiving CS, an indication that transmission of a command is about to start is obtained. Then, in step S2, the LED driver circuit receives the command (CMD) from the upstream circuit, and the transmitter (Tx) is in the state of bypass.

When the received command is the Write Command (WR CMD), in step S3, the LED driver circuit waits for DS, and the transmitter (Tx) outputs 0. Then, by receiving DS, an indication that transmission of the data to be written is about to start is obtained. Then, in step S4, the LED driver circuit receives the data to be written, and the transmitter (Tx) outputs 0. After the data to be written is written, in step S5, the LED driver circuit waits for the change of the level of the synchronization signal (which can also be referred to as being in an idle state), and the transmitter (Tx) is in the state of bypass.

When the received command is the Read Command (RD CMD), in step S6, the LED driver circuit may start a first timer, and the duration of the first timer is a first time period (T1). During the T1, the LED driver circuit may wait for OE, and the transmitter (Tx) outputs 0. When the T1 expires, in step S7, the LED driver circuit may determine whether OE has been received during the T1. If the determination result is yes, the LED driver circuit performs step S8, and if the determination result is no, the LED driver circuit performs step S9.

In step S8, the LED driver circuit may start a second timer, and the duration of the second timer is a second time period (T2). During the T2, the transmitter (Tx) of the LED driver circuit may output the data stored in the LED driver circuit. When the T2 expires, the LED driver circuit ends outputting. Then, the LED driver circuit performs the above step S5.

In addition, in step S9, the LED driver circuit may also start the second timer, and the duration of the second timer is the second time period (T2). During the T2, the transmitter (Tx) is in the state of bypass. When the T2 expires, the LED driver circuit returns to perform the above step S6.

So far, the LED driver circuit completes one write/read operation. After that, the LED driver circuit may return to step S1 again according to the change of the level of the synchronization signal, and prepare for the next write/read operation.

In the present disclosure, the display driver system may enter a power saving mode after completing one or more write/read operations, or may enter the power saving mode after a power on protection mode (which will be described below). Operating in power saving mode may save power consumption and effectively reduce chip power consumption.

According to a first example of the present disclosure, the LED driver circuit may passively enter the power saving mode, for example, may enter the power saving mode according to an command of the control circuit. In addition, according to a second example of the present disclosure, the LED driver circuit may actively enter the power saving mode, for example, the LED driver circuit may judge whether a time period during which it receives specific data from its upstream circuit is greater than a preset threshold to determine whether to enter the power saving mode.

Figure 7:
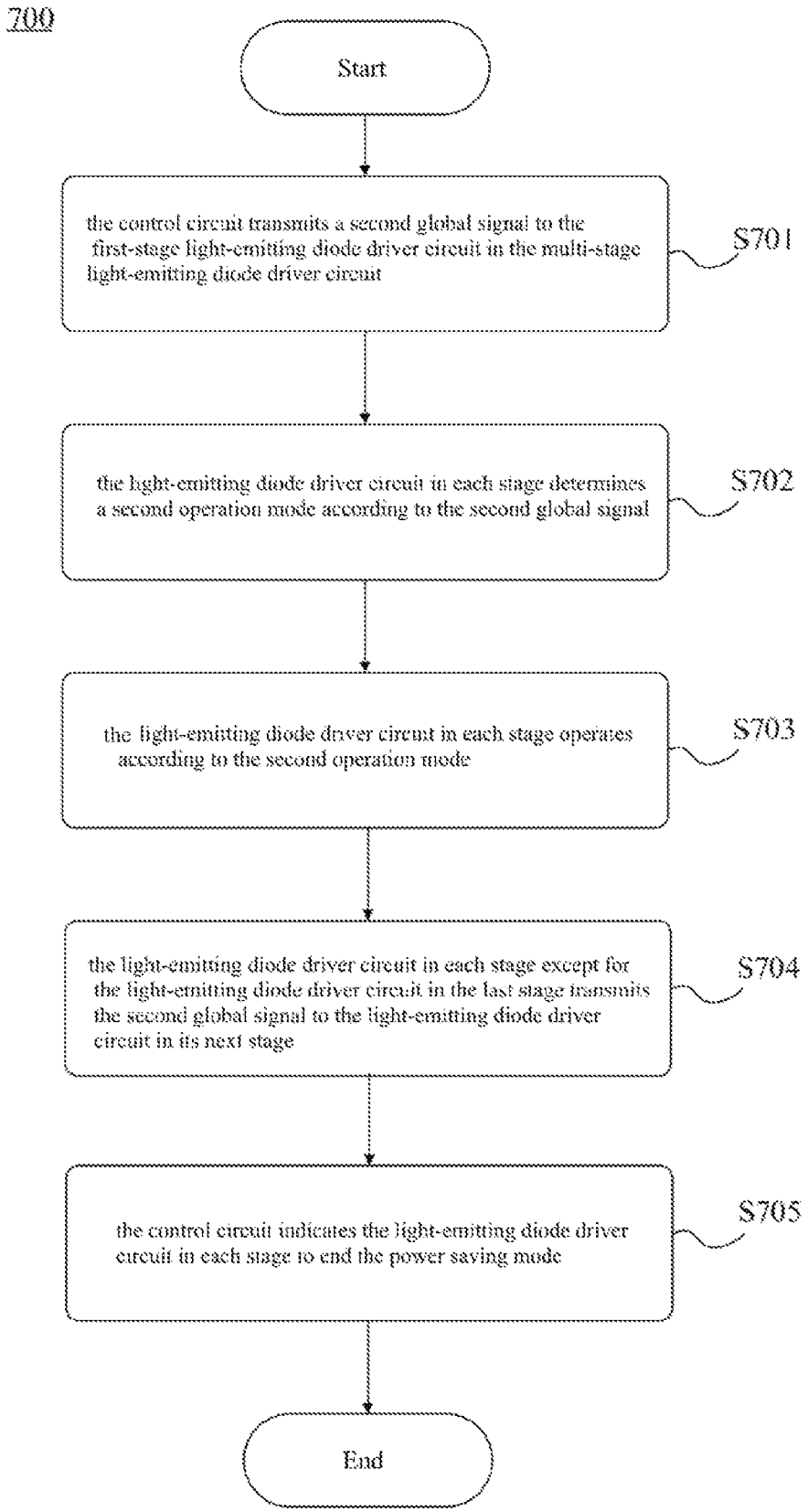
FIG. 7 is a flowchart of a method in which the display driver system enters a power saving mode according to a first example of the embodiments of the present disclosure.

A method in which the display driver system enters the power saving mode according to the first example will be described below in combination with FIG. 7. FIG. 7 is a flowchart of the method in which the display driver system enters the power saving mode according to the first example of the embodiments of the present disclosure. The method 700 shown in FIG. 7 may be performed after the method 200 shown in FIG. 2A, or the method 200' shown in FIG. 2B, or the method 200" shown in FIG. 2C.

As shown in FIG. 7, the method 700 includes four steps, namely step S701, step S702, step S703, and step S704. Specifically, in step S701, the control circuit transmits a second global signal to the first-stage LED driver circuit in the multi-stage LED driver circuit, wherein the second global signal includes a command for indicating another operation mode (represented as a second operation mode) of the LED driver circuit in each stage. In step S702, the LED driver circuit in each stage determines the second operation mode according to the second global signal. In step S703, the LED driver circuit in each stage operates according to the second operation mode. In step S704, the LED driver circuit in each stage except for the LED driver circuit in the last stage transmits the second global signal to the LED driver circuit in its next stage.

It needs to be realized that the above step S701, step S702, step S703, and step S704 may be performed in sequence or not. For example, step S701 may be performed first, then step S702 and step S704 are performed, and finally step S703 is performed.

According to one example of the present disclosure, in step S701, the command in the second global signal for indicating the second operation mode of the LED driver circuit in each stage may be a power saving command (which may be abbreviated as SV CMD), and the second operation mode may be the power saving mode. Or, the power saving command may be carried within the write command.

In addition, the second global signal may also include data related to Clock Training (CT) and Command Transmission Indication (CS). In this case, the data related to Clock Training (CT), the Command Transmission Indication (CS), and the power saving command may be transmitted in sequence.

During the period when an upstream circuit transmits the CT in the second global signal to a LED driver circuit, the LED driver circuit may be in a state of waiting for CT and in a state of bypass. In addition, during the period when the upstream circuit transmits the CS and the SV CMD in the second global signal to the LED driver circuit, the LED driver circuit may write the SV CMD and be in the state of bypass. The LED driver circuit in the last stage may feed the received second global signal back to the control circuit.

In other words, during the period when the control circuit transmits the CT in the second global signal to the first-stage LED driver circuit, the first-stage LED driver circuit may be in the state of waiting for CT and in the state of bypass. During the period when the control circuit transmits the CS and the SV CMD in the second global signal to the first-stage LED driver circuit, the first-stage LED driver circuit may write the SV CMD and be in the state of bypass. In addition, during the period when the LED driver circuit in a stage transmits the CT in the second global signal to the LED driver circuit in its next stage, the LED driver circuit in its next stage may be in the state of waiting for CT and in the state of bypass. During the period when the LED driver circuit in the stage transmits the CS and the SV CMD in the second global signal to the LED driver circuit in its next stage, the LED driver circuit in its next stage may write the SV CMD and be in the state of bypass.

In addition, in step S702, the LED driver circuit in each stage may determine that the operation mode corresponding to the command is the power saving mode according to the second global signal.

In addition, according to one example of the present disclosure, in step S703, the LED driver circuit in each stage in the multi-stage LED driver circuit operating according to the second operation mode may include: the LED driver circuit in the stage disabling at least data transmitting function.

Alternatively, in step S703, the LED driver circuit in each stage in the multi-stage LED driver circuit operating according to the other operation mode may include: the LED driver circuit in the stage transmitting preset data to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage. The preset data described here may be data whose value is a preset value, and the preset value may be, for example, 0. This is because transmitting data 0 to the LED driver circuit in the next stage is more power-saving than transmitting data 1.

In this case, because the first-stage LED driver circuit has received the power saving command issued by the control circuit and entered the power saving mode, even if the control circuit transmits CT to the first-stage LED driver circuit, the first-stage LED driver circuit may output preset data 0 to the LED driver circuit in its next stage, that is, the first-stage LED driver circuit performs power saving data transmission. In addition, the LED driver circuit in each stage except for the first-stage LED driver circuit has also received the power saving command issued by the control circuit and entered the power saving mode, so it may output 0 to the LED driver circuit in its next stage, that is to say, the LED driver circuit in each stage except for the first-stage LED driver circuit performs power saving data transmission.

In addition, it is also possible to appropriately shut down (make it inoperative) some circuits in the transmitter of the LED driver circuit in each stage to achieve a better power saving effect.

In addition, after step S704, the method 700 may further include step S705. In step S705, the control circuit indicates the LED driver circuit in each stage to end the power saving mode. For example, the control circuit may change the level of the synchronization signal (for example, from a high level to a low level, or from a low level to a high level) transmitted by the control circuit to the LED driver circuit in each stage. Correspondingly, the LED driver circuit in each stage may end the power saving mode after detecting the change in the level of the synchronization signal. After the power saving mode is ended, the display driver system may prepare for the next write/read operation.

In the following, taking the display driver system including one control circuit and a three-stage LED driver circuit and the display driver system performing the power saving operation as an example, the specific flow of the method 700 will be described again in combination with FIG. 8.

Figure 8:
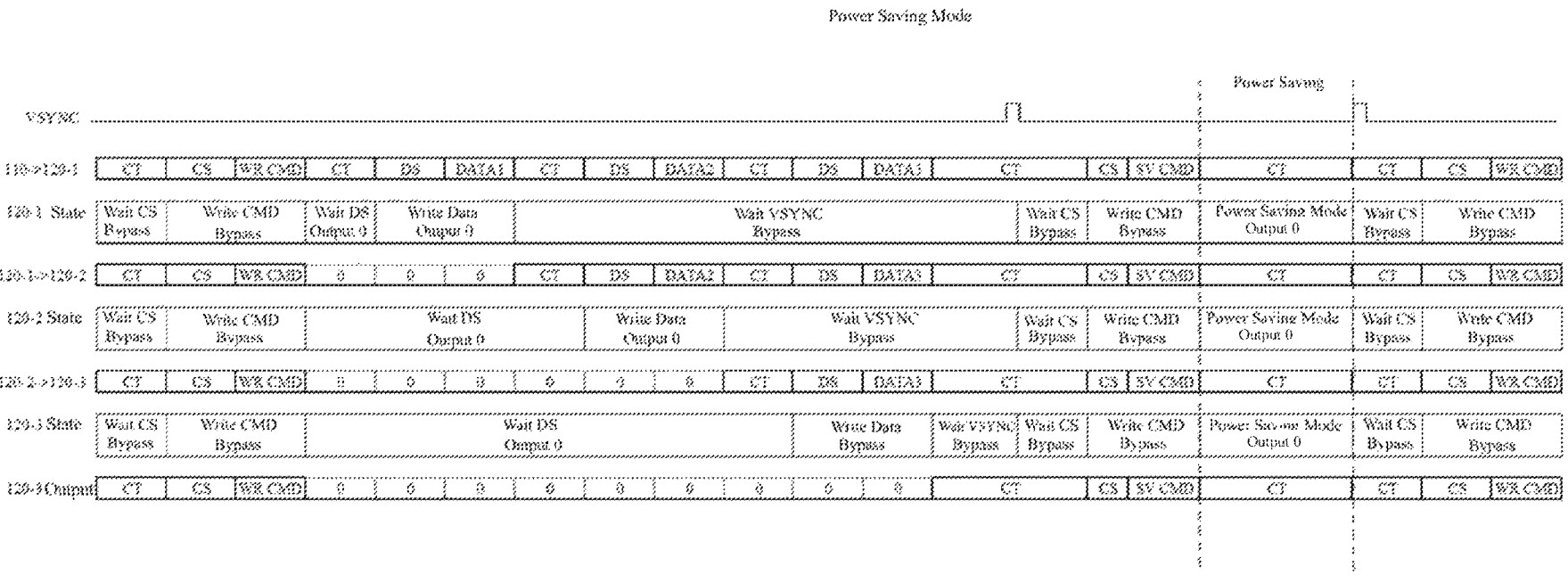
FIG. 8 shows a schematic diagram of a process in which the display driver system enters a power saving mode.

FIG. 8 shows a schematic diagram of a process in which the display driver system enters the power saving mode. FIG. 8 shows that the display driver system enters the power saving mode after completing one write operation. As shown in FIG. 8, after the display driver system completes the write operation, the control circuit may transmit a second global signal to the first-stage LED driver circuit, and the second global signal includes data related to the Clock Training (CT), Command Transmission Indication (CS), and power saving command (SV CMD), and the data related to Clock Training (CT), the Command Transmission Indication (CS) and the power saving command are transmitted in sequence.

During the period when the control circuit transmits the CT in the second global signal to the first-stage LED driver circuit, the first-stage LED driver circuit may be in a state of waiting for CT and in a state of bypass. During the period when the control circuit transmits the CS and the SV CMD in the second global signal to the first-stage LED driver circuit, the first-stage LED driver circuit may write the SV CMD and be in the state of bypass. In addition, during the period when the first-stage LED driver circuit transmits the CT in the second global signal to the second-stage LED driver circuit, the second-stage LED driver circuit may be in the state of waiting for CT and in the state of bypass. During the period when the first-stage LED driver circuit transmits the CS and the SV CMD in the second global signal to the second-stage LED driver circuit, the second-stage LED driver circuit may write the SV CMD and be in the state of bypass. In addition, during the period when the second-stage LED driver circuit transmits the CT in the second global signal to the third-stage LED driver circuit, the third-stage LED driver circuit may be in the state of waiting for CT and in the state of bypass. During the period when the second-stage LED driver circuit transmits the CS and the SV CMD in the second global signal to the third-stage LED driver circuit, the third-stage LED driver circuit may write the SV CMD and be in the state of bypass. In addition, the third-stage LED driver circuit may feed the received second global signal back to the control circuit.

The first-stage, second-stage, and third-stage LED driver circuit all have received the power saving command issued by the control circuit, and may enter the power saving mode. At this time, if the control circuit transmits the CT to the first-stage LED driver circuit, the first-stage LED driver circuit may output 0 to the second-stage LED driver circuit, and the second-stage LED driver circuit may output 0 to the third-stage LED driver circuit, and the third-stage LED driver circuit may output 0 to the control circuit.

The control circuit may change the level of the synchronization signal transmitted by the control circuit to the LED driver circuit in each stage (as shown in FIG. 8, from high level to low level). Correspondingly, the LED driver circuit in each stage may end the power saving mode after detecting the change in the level of the synchronization signal. After the power saving mode is ended, the display driver system may prepare for the next write operation.

It should be understood that the above example is based on ideally aligned timing, that is, there is no delay in signal transmission process. When there is a delay in the signal transmission process, signals may be delayed stage by stage between the control circuit and the LED driver circuit in each stage and between the LED driver circuits in adjacent stages (for example, the delay shown in FIG. 4). However, this delay does not affect the operations of the control circuit and the LED driver circuit in each stage described above.

Figure 9:
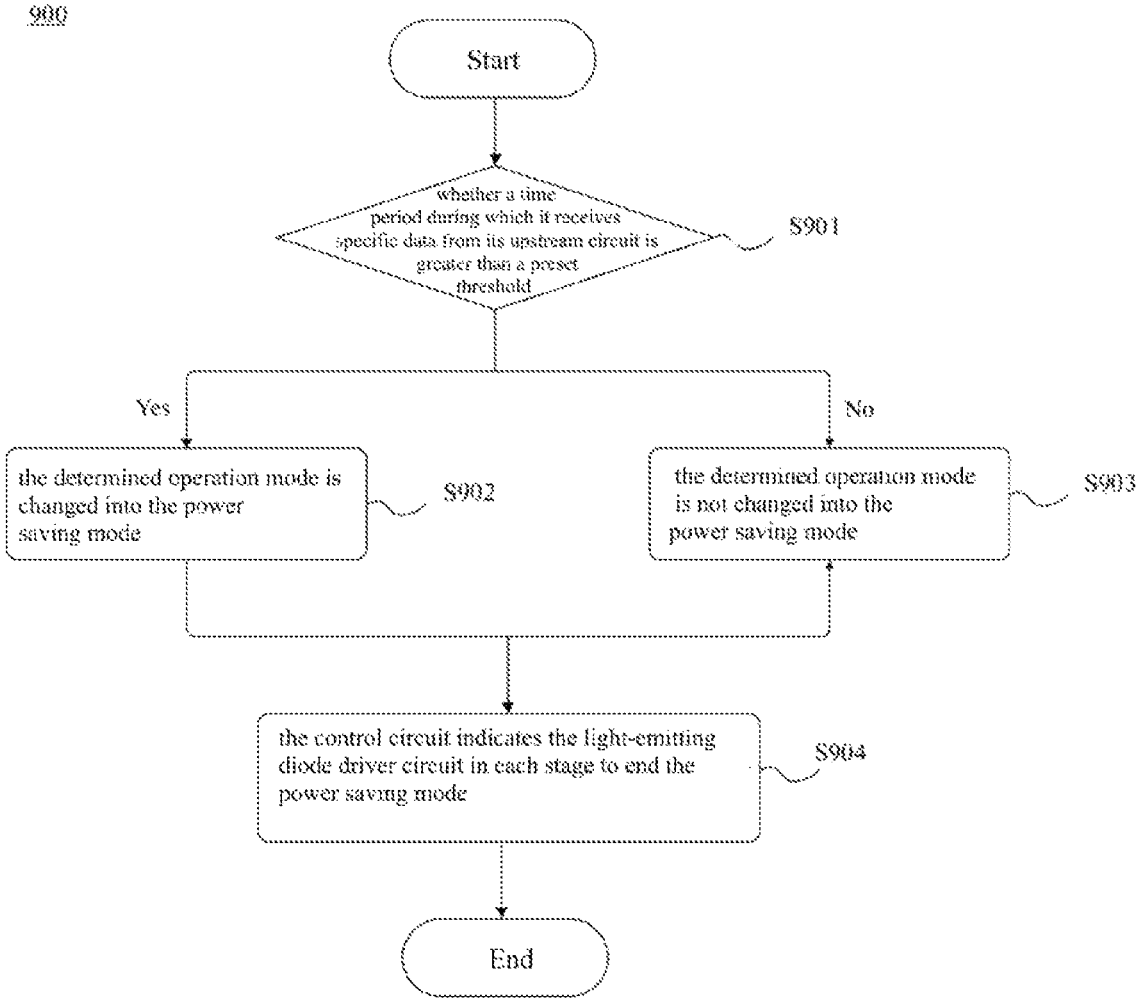
FIG. 9 is a flowchart of a method in which the display driver system enters a power saving mode according to a second example of the embodiments of the present disclosure.

The method in which the display driver system enters the power saving mode according to the second example will be described below in combination with FIG. 9. FIG. 9 is a flowchart of a method in which the display driver system enters the power saving mode according to the second example of the embodiments of the present disclosure. The method 900 shown in FIG. 9 may be performed after the method 200 shown in FIG. 2A, or the method 200' shown in FIG. 2B, or the method 200" shown in FIG. 2C.

As shown in FIG. 9, the method 900 includes three steps, namely step S901, step S902, and step S903. Specifically, in step S901, the LED driver circuit in each stage may judge whether a time period during which it receives specific data from its upstream circuit is greater than a preset threshold. When the time period during which the LED driver circuit in a stage receives the specific data from its upstream circuit is greater than the preset threshold, in step S902, the LED driver circuit in the stage may change the determined operation mode into the power saving mode. When the time period during which the LED driver circuit in the stage receives the specific data from its upstream circuit is not greater than the preset threshold, in step S903, the LED driver circuit in the stage may not change the determined operation mode into the power saving mode. For example, the specific data may be CT. For the first-stage LED driver circuit, its upstream circuit is the control circuit; and for LED driver circuit in each stage except for the first-stage LED driver circuit, its upstream circuit is the LED driver circuit in its previous stage.

According to one example of the present disclosure, each LED driver circuit may start a timer when it detects the specific data, and the duration of the timer is a preset threshold. When the time period of the preset threshold expires, if the specific data is still detectable by the LED driver circuit, the LED driver circuit may change the current operation mode to the power saving mode.

The specific data mentioned here may be data whose value is a preset value, and the preset value may be 0 or 1, for example.

In addition, after step S902 or S903, the method 900 may further include step S904. In step S904, the control circuit indicates the LED driver circuit in each stage to end the power saving mode. For example, the control circuit may change the level of the synchronization signal (for example, from a high level to a low level, or from a low level to a high level) transmitted by the control circuit to the LED driver circuit in each stage. Correspondingly, the LED driver circuit in each stage may end the power saving mode after detecting the change in the level of the synchronization signal.

After the power saving mode is ended, the display driver system may prepare for the next write/read operation.

In the present disclosure, the display driver system may enter the power on protection mode after being powered on, and enter the write/read mode again after the display driver system operates normally. In this way, an ESD tolerance of the chip may be greatly improved, thereby extending the life of the chip.

Figure 10:
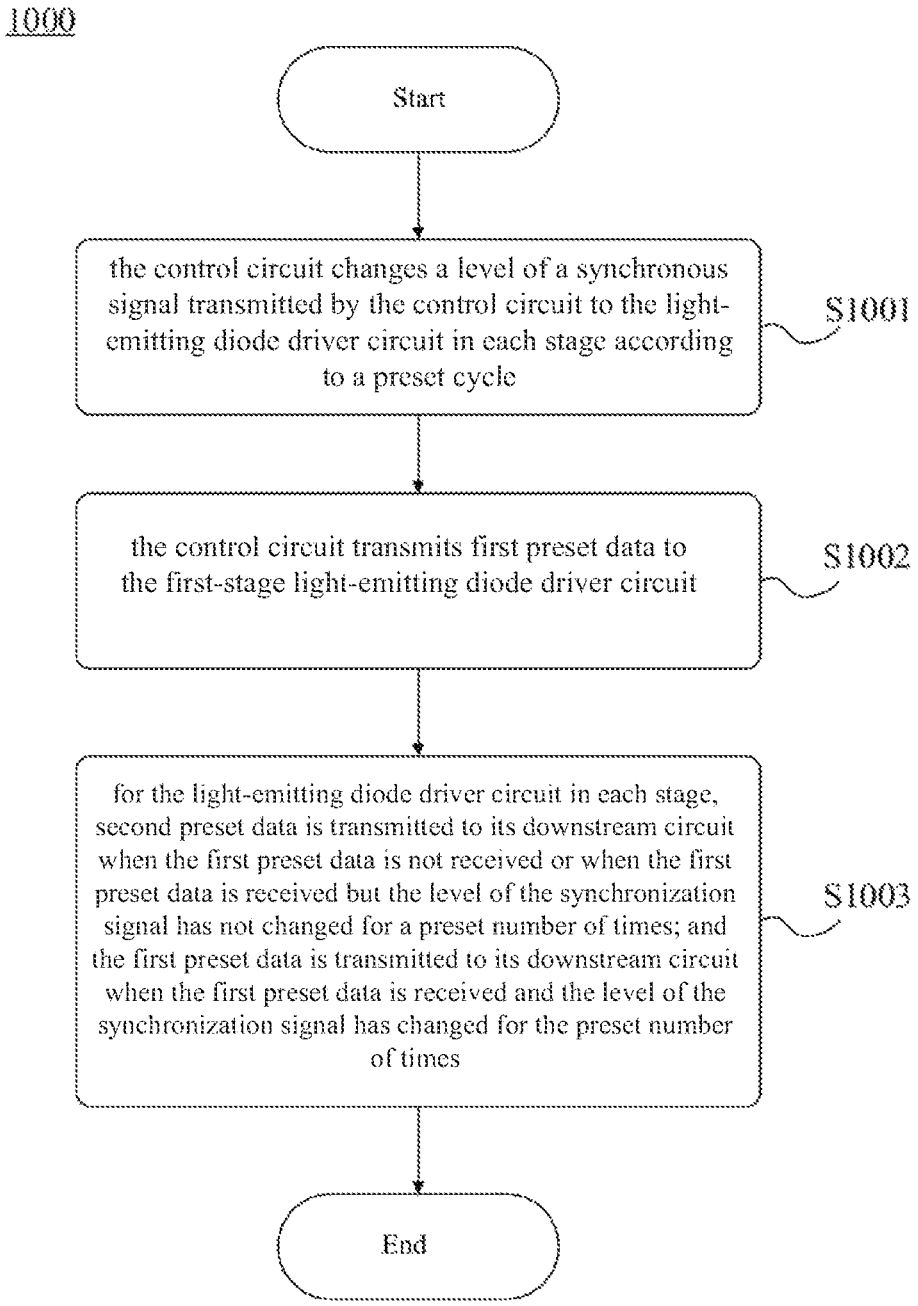
FIG. 10 is a flowchart of a method in which the display driver system performs a power on protection operation according to the embodiments of the present disclosure.

The specific flow of the power on protection operation of the display driver system will be described below in combination with FIG. 10. FIG. 10 is a flowchart of a method in which the display driver system performs the power on protection operation according to the embodiments of the present disclosure. As shown in FIG. 10, the method 1000 includes step S1001, step S1002, and step S1003.

Specifically, the control circuit may perform step S1001 after being powered on. In step S1001, the control circuit changes a level of a synchronous signal transmitted by the control circuit to the LED driver circuit in each stage according to a preset cycle. For example, the control circuit may change the level of the synchronization signal transmitted by the control circuit to the LED driver circuit in each stage from a high level to a low level according to the preset cycle, or the control circuit may change the level of the synchronization signal transmitted by the control circuit to the LED driver circuit in each stage from a low level to a high level according to the preset cycle.

In addition, after the control circuit is powered on and before transmitting the global signal and the first signal for the LED driver circuit in each stage to the first-stage LED driver circuit in the multi-stage LED driver circuit, step S1002 may be performed. In step S1002, the control circuit transmits first preset data to the first-stage LED driver circuit.

Then, in step S1003, for the LED driver circuit in each stage in the multi-stage LED driver circuit, second preset data is transmitted to its downstream circuit when the first preset data is not received or when the first preset data is received but the level of the synchronization signal has not changed for a preset number of times (for example, 2 times); and the first preset data is transmitted to its downstream circuit when the first preset data is received and the level of the synchronization signal has changed for the preset number of times.

As described above, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage.

Then, after step S1003, in response to receiving the first preset data from the LED driver circuit in the last stage, the control circuit starts transmitting the global signal and the first signal for the LED driver circuit in each stage to the first-stage LED driver circuit in the multi-stage LED driver circuit, so as to perform the write/read operation.

Through the above method, after the control circuit receives the first preset data fed back by the LED driver circuit in the last stage, the control circuit and the LED driver circuit in each stage enter the normal state together to perform the write/read operation.

The value of the first preset data described above is different from the value of the second preset data. For example, the value of the first preset data may be 0, and the value of the second preset data may be 1. Alternatively, the value of the first preset data may be 1, and the value of the second preset data may be 0.

In the following, taking the display driver system including one control circuit and a three-stage LED driver circuit and performing one power on protection operation as an example, the specific flow of the method 1000 will be described again in combination with FIGS. 11 and 12.

Figure 11:
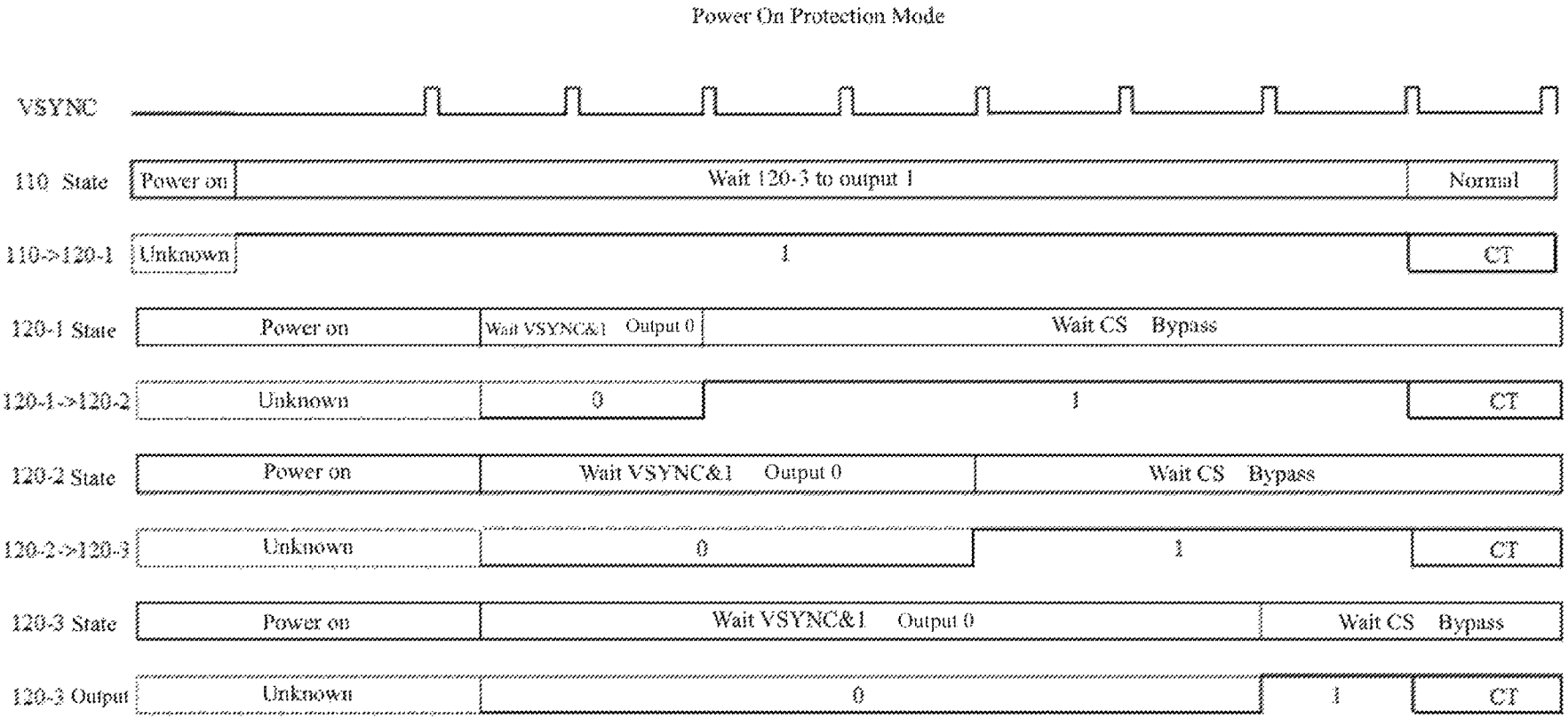
FIG. 11 shows a schematic diagram of a process in which the display driver system enters a power on protection mode.

FIG. 11 shows a schematic diagram of the process in which the display driver system enters the power on protection mode, in which the control circuit is powered on first, and the LED driver circuit in each stage is powered on afterwards. As shown in FIG. 11, the control circuit is powered on first, and continues to transmit 1 to the first-stage LED driver circuit after being powered on. The first-stage LED driver circuit transmits 0 to the second-stage LED driver circuit when the first-stage LED driver circuit does not receive 1 or receives 1 but the level of the synchronization signal has not changed for twice. Similarly, the second-stage LED driver circuit transmits 0 to the third-stage LED driver circuit when the second-stage LED driver circuit does not receive 1 or receives 1 but the level of the synchronization signal has not changed for twice. The third-stage LED driver circuit transmits 0 to the control circuit when the third-stage LED driver circuit does not receive 1 or receives 1 but the level of the synchronization signal has not changed for twice. In addition, the first-stage LED driver circuit transmits 1 to the second-stage LED driver circuit when the first-stage LED driver circuit receives 1 and the level of the synchronization signal has changed for twice. Similarly, the second-stage LED driver circuit transmits 1 to the third-stage LED driver circuit when the second-stage LED driver circuit receives 1 and the level of the synchronization signal has changed for twice. The third-stage LED driver circuit transmits 1 to the control circuit when the third-stage LED driver circuit receives 1 and the level of the synchronization signal has not changed for twice. After the control circuit receives 1 fed back from the third-stage LED driver circuit, the control circuit and the LED driver circuit in each stage may enter the normal state together to perform the write/read operation (for example, to transmit the CT in the global signal).

Figure 12:
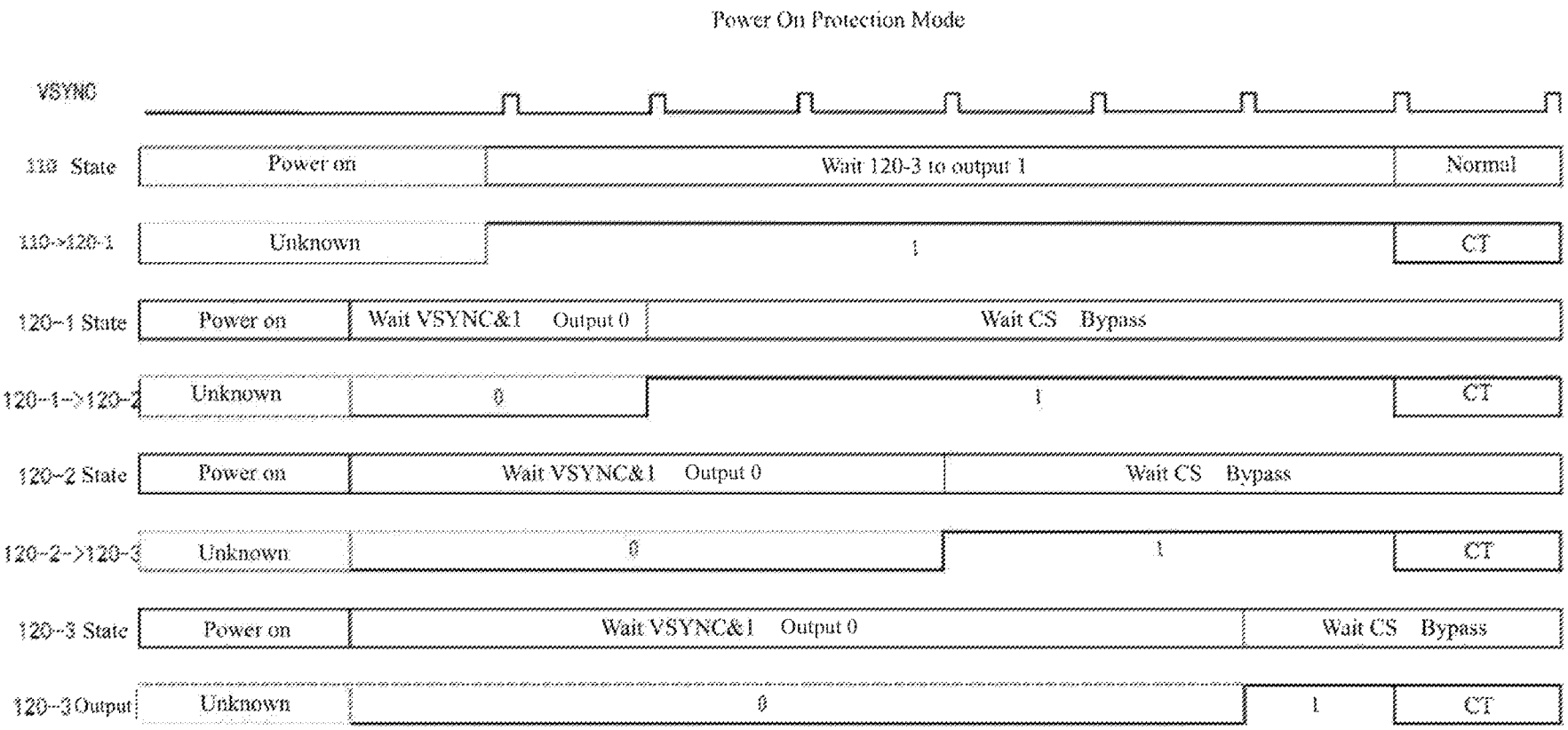
FIG. 12 shows schematic diagram of another process in which the display driver system enters a power on protection mode.

FIG. 12 shows another schematic diagram of the process in which the display driver system enters the power on protection mode. FIG. 12 is similar to FIG. 11, the difference therebetween is that, in the example of FIG. 12, the LED driver circuit in each stage is powered on first, and the control circuit is powered on afterwards.

As shown in FIG. 12, the LED driver circuit in each stage is powered on first, and waits for the first specific data 1 after being powered on. After that, the control circuit is powered on, and continues to transmit 1 to the first-stage LED driver circuit after being powered on. The first-stage LED driver circuit transmits 0 to the second-stage LED driver circuit when the first-stage LED driver circuit does not receive 1 or receives 1 but the level of the synchronization signal has not changed for twice. Similarly, the second-stage LED driver circuit transmits 0 to the third-stage LED driver circuit when the second-stage LED driver circuit does not receive 1 or receives 1 but the level of the synchronization signal has not changed for twice. The third-stage LED driver circuit transmits 0 to the control circuit when the third-stage LED driver circuit does not receive 1 or receives 1 but the level of the synchronization signal has not changed for twice. In addition, the first-stage LED driver circuit transmits 1 to the second-stage LED driver circuit when the first-stage LED driver circuit receives 1 and the level of the synchronization signal has changed for twice. Similarly, the second-stage LED driver circuit transmits 1 to the third-stage LED driver circuit when the second-stage LED driver circuit receives 1 and the level of the synchronization signal has changed twice. The third-stage LED driver circuit transmits 1 to the control circuit when the third-stage LED driver circuit receives 1 and the level of the synchronization signal has changed for twice. After the control circuit receives 1 fed back from the third-stage LED driver circuit, the control circuit and the LED driver circuit in each stage may enter the normal state together to perform the write/read operation (for example, to transmit the CT in the global signal).

It should be understood that the above example is based on ideally aligned timing, that is, there is no delay in signal transmission process. When there is a delay in the signal transmission process, signals may be delayed stage by stage between the control circuit and the LED driver circuit in each stage and between the LED driver circuits in adjacent stages (for example, the delay shown in FIG. 4). However, this delay does not affect the operations of the control circuit and the LED driver circuit in each stage described above.

So far, the specific process in which the display driver system performs the write/read/power saving/power on protection operations according to the signal transmission protocol has been described. In the above process, the signals transmitted between the control circuit and the first-stage LED driver circuit, between the LED driver circuits in various stages, and between the LED driver circuit in the last stage and the control circuit are all data signals. For example, the global signal and the first signal for the LED driver circuit in each stage are data signals.

In addition, a clock signal may also be transmitted between the control circuit and the first-stage LED driver circuit, between the LED driver circuits in various stages, and between the LED driver circuit in the last stage and the control circuit. For example, the control circuit may transmit the clock signal to the first-stage LED driver circuit, and the LED driver circuit in each stage except for the LED driver circuit in the last stage transmits the clock signal to the LED driver circuit in its next stage.

According to one example of the present disclosure, both the data signal and/or the clock signal may be transmitted through a differential line. Specifically, the control circuit may transmit the global signal and the first signal for the LED driver circuit in each stage to the first-stage LED driver circuit in the multi-stage LED driver circuit through the differential line. In addition, the LED driver circuit in each stage may transmit the global signal and the first signal for the LED driver circuit in each stage after the LED driver circuit in the stage to the LED driver circuit in its next stage through the differential line. In addition, the control circuit may transmit the clock signal to the first-stage LED driver circuit through the differential line, and the LED driver circuit in each stage may transmit the clock signal to the LED driver circuit in its next stage through the differential line.

The data signal and clock signal are transmitted in a differential manner, so that the data signal and clock signal may be transmitted with a small voltage swing (about hundreds of mV), thereby effectively suppressing the influence of noise and increasing the signal transmission speed. In addition, transmitting the clock signal in sequence may improve the distortion of the clock signal.

In addition, in the present disclosure, the LED driver circuit in each stage may be applied to drive a display with Micro LEDs as display pixels. The Micro LEDs differ from ordinary LEDs in that they are smaller in size, for example, only around 1-10 μm class. Therefore, the Micro LEDs may make the LED structure design more thin, miniaturized, and arrayed, thereby providing extremely high color saturation.

Through the method for the display driver system of the above embodiments, through the specific signal transmission protocol, each LED driver circuit may identify the data that is to be transmitted from the control circuit to itself, so that no additional pins or chip select signals are required to determine the corresponding LED driver circuit, thereby avoiding the use of SPI and thus avoiding some defects caused by SPI. In addition, the power saving mode is set for the display driver system, which may save power consumption and effectively reduce chip power consumption. In addition, the power on protection mode is set for the display driver system, which may greatly improve the ESD tolerance of the chip, thereby extending the life of the chip. In addition, the data signal and clock signal are transmitted in the differential manner, so that the data signal and clock signal may be transmitted with a small voltage swing (about hundreds of mV), thereby effectively suppressing the influence of noise and increasing the signal transmission speed. In addition, transmitting the clock signal in sequence may improve the distortion of the clock signal.

Hereinafter, a display driver system according to embodiments of the present disclosure will be described. In the present disclosure, the display driver system may include a control circuit and a cascade-connected multi-stage LED driver circuit. As described above, as shown in FIG. 1, the display driver system 100 may include a control circuit 110 and a three-stage LED driver circuit, the three-stage LED driver circuit including a first-stage LED driver circuit 120-1, a second-stage LED driver circuit 120-2 and a third-stage LED driver circuit 120-3, respectively.

In the present disclosure, the control circuit is configured to transmit a global signal and a first signal for the LED driver circuit in each stage to the first-stage LED driver circuit in the multi-stage LED driver circuit, where the global signal includes a command for indicating an operation mode of the LED driver circuit in each stage. The LED driver circuit in each stage is configured to: determine the operation mode corresponding to the command according to the global signal, identify a corresponding first signal of the LED driver circuit in the stage, and operate according to the determined operation mode and the corresponding first signal. The LED driver circuit in each stage except for the LED driver circuit in the last stage is further configured to transmit the global signal to the LED driver circuit in its next stage, and in response to a completion of operation according to the determined operation mode and the corresponding first signal, transmit the first signal for the LED driver circuit in each stage after the LED driver circuit in the stage to the LED driver circuit in the stage.

In a write mode, during the period when the control circuit transmits CT in the global signal to the first-stage LED driver circuit, the first-stage LED driver circuit may be in a state of waiting for CT and in a state of bypass. During the period when the control circuit transmits CS and WR CMD in the global signal to the first-stage LED driver circuit, the first-stage LED driver circuit may write the WR CMD and be in the state of bypass. In addition, during the period when the LED driver circuit in a stage transmits the CT in the global signal to the LED driver circuit in its next stage, the LED driver circuit in its next stage may be in the state of waiting for CT and in the state of bypass. During the period when the LED driver circuit in the stage transmits the CS and the WR CMD in the global signal to the LED driver circuit in its next stage, the LED driver circuit in its next stage may write the WR CMD and be in the state of bypass.

In addition, the LED driver circuit in each stage in the multi-stage LED driver circuit may be configured to: transmit preset data to a downstream circuit of the LED driver circuit in the stage in case that the data to be written for the LED driver circuit in the stage is not received; write the data to be written for the LED driver circuit in the stage and transmit the preset data to the downstream circuit in case that the data to be written for the LED driver circuit in the stage is received; wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage.

In addition, the LED driver circuit in each stage except for the LED driver circuit in the last stage may be configured to, in response to a completion of operation according to the determined operation mode and the corresponding first signal, transmit the first signal for the LED driver circuit in each stage after the LED driver circuit in the stage to the LED driver circuit in its next stage. For example, in response to the completion of operation according to the determined operation mode and the corresponding first signal, the LED driver circuit in each stage except for the LED driver circuit in the last stage may enter a state of waiting for the control circuit to indicate to end the determined operation mode (for example, waiting for the control circuit to change a level of a synchronization signal), and be in the state of bypass. When being in the state of bypass, the LED driver circuit in each stage except for the LED driver circuit in the last stage may not process the received first signal for the LED driver circuit in each stage after the LED driver circuit in the stage, but transmit the first signal for the LED driver circuit in each stage after the LED driver circuit in the stage to the LED driver circuit in its next stage.

In addition, the control circuit may also be configured to transmit specific data to the first-stage LED driver circuit in the multi-stage LED driver circuit after the control circuit transmits the global signal and the first signal for the LED driver circuit in each stage to the first-stage LED driver circuit in the multi-stage LED driver circuit. According to the above description, after writing the data to be written, the LED driver circuit in each stage is in the state of bypass, therefore, the LED driver circuit in each stage may transmit the specific data to its downstream circuit. Specifically, the LED driver circuit in each stage except for the LED driver circuit in the last stage may transmit the specific data to the LED driver circuit in its next stage; and the LED driver circuit in the last stage may feed the specific data back to the control circuit.

In addition, the control circuit may also be configured to indicate the LED driver circuit in each stage to end the determined operation mode. For example, the control circuit may change a level of a synchronization signal (for example, from a high level to a low level, or from a low level to a high level) transmitted by the control circuit to the LED driver circuit in each stage. Correspondingly, the LED driver circuit in each stage may end the current operation mode after detecting the change in the level of the synchronization signal.

In a read mode, during the period when the control circuit transmits CT in the global signal to the first-stage LED driver circuit, the first-stage LED driver circuit may be in a state of waiting for CT and in a state of bypass. During the period when the control circuit transmits CS and RD CMD in the global signal to the first-stage LED driver circuit, the first-stage LED driver circuit may write the RD CMD and be in the state of bypass. In addition, during the period when the LED driver circuit in a stage transmits the CT in the global signal to the LED driver circuit in its next stage, the LED driver circuit in its next stage may be in the state of waiting for CT and in the state of bypass. During the period when the LED driver circuit in the stage transmits the CS and the RD CMD in the global signal to the LED driver circuit in its next stage, the LED driver circuit in its next stage may write the RD CMD and be in the state of bypass. The LED driver circuit in the last stage may feed the received global signal back to the control circuit.

In this mode, the control circuit may be configured to transmit the first signal for the LED driver circuit in the i-th stage in a preset time period corresponding to the LED driver circuit in the i-th stage, wherein the preset time period includes a first time period (for example, T1) and a second time period (for example, T2), and the control circuit transmits first data for the LED driver circuit in the i-th stage in the first time period and transmits second data for the LED driver circuit in the i-th stage in the second time period, wherein, the multi-stage LED driver circuit is an N-stage LED driver circuit, N is an integer greater than or equal to 3, and i is an integer greater than or equal to 1 and less than or equal to N.

In addition, according to one example of the present disclosure, the LED driver circuit in each stage in the multi-stage LED driver circuit may be configured to: receive the first data for the LED driver circuit in the stage in the first time period corresponding to the LED driver circuit in the stage and transmit preset data to its downstream circuit; identify an enable command in the first data for the LED driver circuit in the stage; receive the second data for the LED driver circuit in the stage in the second time period corresponding to the LED driver circuit in the stage, and in response to the enable command, transmit the data to be read stored in the LED driver circuit in the stage to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage.

In addition, the LED driver circuit in each stage except for the LED driver circuit in the last stage may also be configured to transmit the first signal for the LED driver circuit in each stage after the LED driver circuit in the stage to the LED driver circuit in its next stage, in response to a completion of operation according to the determined operation mode and the corresponding first signal for the LED driver circuit in the stage. For example, in response to the completion of operation according to the determined operation mode and the corresponding first signal, the LED driver circuit in each stage except for the LED driver circuit in the last stage may enter a state of waiting for the control circuit to indicate to end the determined operation mode (for example, waiting for the control circuit to change a level of a synchronization signal), and be in the state of bypass. When being in the state of bypass, the LED driver circuit in each stage except for the LED driver circuit in the last stage may not process the received first signal for the LED driver circuit in each stage after the LED driver circuit in the stage, but transmit the first signal for the LED driver circuit in each stage after the LED driver circuit in the stage to the LED driver circuit in its next stage.

Specifically, during the period when the control circuit transmits the first data (for example, CT, OE) for the first-stage LED driver circuit to the first-stage LED driver circuit in the first time period corresponding to the first-stage LED driver circuit, the first-stage LED driver circuit may receive the first data for the first-stage LED driver circuit, be in a state of waiting for enable (for example, OE) command, and output preset data to the LED driver circuit in its next stage. The first-stage LED driver circuit may identify the enable command in the first data for the first-stage LED driver circuit. During the period when the control circuit transmits the second data (for example, CT) for the first-stage LED driver circuit to the first-stage LED driver circuit in the second time period corresponding to the first-stage LED driver circuit, the first-stage LED driver circuit may receive the second data for the first-stage LED driver circuit, be in the read mode, and transmit the data to be read stored in the first-stage LED driver circuit to the LED driver circuit in its next stage (the second stage).

In addition, for the LED driver circuit in each stage except for the first-stage LED driver circuit and the LED driver circuit in the last stage in the multi-stage LED driver circuit, during the period when the LED driver circuit in a stage (e.g., i-th stage) transmits the first data (for example, CT, OE) for the LED driver circuit in its next stage (e.g. (i+1)-th stage) to the LED driver circuit in its next stage (e.g. (i+1)-th stage) in the first time period corresponding to the LED driver circuit in its next stage (e.g. (i+1)-th stage), the LED driver circuit in its next stage (e.g. (i+1)-th stage) may receive the first data for the LED driver circuit in its next stage (e.g. (i+1)-th stage), be in the state of waiting for the enable (for example, OE) command, and output preset data to the LED driver circuit in its next stage (e.g. (i+2)-th stage). The LED driver circuit in each stage may identify the enable command in the first data for the LED driver circuit in the stage. During the period when the LED driver circuit in the stage (e.g., i-th stage) transmits the second data (for example, CT) for the LED driver circuit in its next stage (e.g. (i+1)-th stage) to the LED driver circuit in its next stage (e.g. (i+1)-th stage) in the second time period corresponding to the LED driver circuit in its next stage (e.g. (i+1)-th stage), the LED driver circuit in its next stage (e.g. (i+1)-th stage) may receive the second data for the LED driver circuit in its next stage (e.g. (i+1)-th stage), be in the read mode, and transmit the data to be read stored in the LED driver circuit in its next stage (e.g. (i+1)-th stage) to the LED driver circuit in its next stage (e.g. (i+2)-th stage).

In addition, for the LED driver circuit in the last stage in the multi-stage LED driver circuit, during the period when the LED driver circuit in its previous stage transmits the first data (for example, CT, OE) for the LED driver circuit in the last stage to the LED driver circuit in the last stage in the first time period corresponding to the LED driver circuit in the last stage, the LED driver circuit in the last stage may receive the first data for the LED driver circuit in the last stage, be in the state of waiting for the enable (for example, OE) command, and output preset data to the control circuit. The LED driver circuit in the last stage may identify the enable command in the first data for the LED driver circuit in the last stage. During the period when the LED driver circuit in its previous stage transmits the second data (for example, CT) for the LED driver circuit in the last stage to the LED driver circuit in the last stage in the second time period corresponding to the LED driver circuit in the last stage, the LED driver circuit in the last stage may receive the second data for the LED driver circuit in the last stage, be in the read mode, and transmit the data to be read stored in the LED driver circuit in the last stage to the control circuit.

In addition, for the LED driver circuit in each stage except for the first-stage LED driver circuit in the multi-stage LED driver circuit, in one or more preset time periods before the first time period corresponding to the LED driver circuit in the stage, the LED driver circuit in the stage transmits the data received from the LED driver circuit in its previous stage to its downstream circuit. For example, for the LED driver circuit in each stage except for the first-stage LED driver circuit in the multi-stage LED driver circuit, in the first time period included in one or more preset time periods before the first time period corresponding to the LED driver circuit in the stage, the LED driver circuit in the stage receives the preset data from the LED driver circuit in its previous stage, and transmits the preset data to its downstream circuit, and in the second time period included in one or more preset time periods, the LED driver circuit in the stage receive the data to be read which is from the LED driver circuit in its previous stage from the LED driver circuit in its previous stage, and transmits the data to be read which is from the LED driver circuit in its previous stage to the downstream circuit.

In addition, the control circuit may also be configured to transmit specific data to the first-stage LED driver circuit in the multi-stage LED driver circuit after the control circuit transmits the global signal and the first signal for the LED driver circuit in each stage to the first-stage LED driver circuit in the multi-stage LED driver circuit. According to the above description, after outputting the data to be read, the LED driver circuit in each stage is in the state of bypass, therefore, the LED driver circuit in each stage may transmit specific data to its downstream circuit. Specifically, the LED driver circuit in each stage except for the LED driver circuit in the last stage may transmit the specific data to the LED driver circuit in its next stage, and the LED driver circuit in the last stage may feed the specific data back to the control circuit.

In addition, the control circuit may be further configured to indicate the LED driver circuit in each stage to end the determined operation mode. For example, the control circuit may change a level of a synchronization signal (for example, from a high level to a low level, or from a low level to a high level) transmitted by the control circuit to the LED driver circuit in each stage. Correspondingly, the LED driver circuit in each stage may end the current operation mode after detecting the change in the level of the synchronization signal.

In a power saving mode, according to a first example of the present disclosure, the LED driver circuit may passively enter the power saving mode, for example, may enter the power saving mode according to a command of the control circuit. In addition, according to a second example of the present disclosure, the LED driver circuit may actively enter the power saving mode, for example, the LED driver circuit may judge whether a time period during which it receives specific data from its upstream circuit is greater than a preset threshold to determine whether to enter the power saving mode.

In the first example, the control circuit may be configured to transmit a second global signal to the first-stage LED driver circuit in the multi-stage LED driver circuit, wherein the second global signal includes a command for indicating another operation mode of the LED driver circuit in each stage. The LED driver circuit in each stage may be configured to determine the other operation mode according to the second global signal. The LED driver circuit in each stage may be further configured to operate according to the other operation mode. The LED driver circuit in each stage except for the LED driver circuit in the last stage may be configured to transmit the second global signal to the LED driver circuit in its next stage.

During the period when an upstream circuit transmits CT in the second global signal to a LED driver circuit, the LED driver circuit may be in a state of waiting for CT and in a state of bypass. In addition, during the period when the upstream circuit transmits CS and SV CMD in the second global signal to the LED driver circuit, the LED driver circuit may write the SV CMD and be in the state of bypass. The LED driver circuit in the last stage may feed the received a second global signal back to the control circuit.

In other words, during the period when the control circuit transmits the CT in the second global signal to the first-stage LED driver circuit, the first-stage LED driver circuit may be in the state of waiting for CT and in the state of bypass. During the period when the control circuit transmits the CS and the SV CMD in the second global signal to the first-stage LED driver circuit, the first-stage LED driver circuit may write the SV CMD and be in the state of bypass. In addition, during the period when the LED driver circuit in a stage transmits the CT in the second global signal to the LED driver circuit in its next stage, the LED driver circuit in its next stage may be in the state of waiting for CT and in the state of bypass. During the period when the LED driver circuit in the stage transmits the CS and the SV CMD in the second global signal to the LED driver circuit in its next stage, the LED driver circuit in its next stage may write the SV CMD and be in the state of bypass.

In this example, the LED driver circuit in each stage in the multi-stage LED driver circuit may at least disable data transmission function. Alternatively, the LED driver circuit in each stage in the multi-stage LED driver circuit may transmit preset data to its downstream circuit, wherein, for the LED driver circuit in the last stage, its downstream circuit is the control circuit, and for LED driver circuit in each stage except the LED driver circuit in the last stage, its downstream circuit is the LED driver circuit in its next stage. The preset data described here may be data whose value is a preset value, and the preset value may be, for example, 0. This is because transmitting data 0 to the LED driver circuit in its next stage is more power-saving than transmitting data 1.

In this case, because the first-stage LED driver circuit has received the power saving command issued by the control circuit and entered the power saving mode, even if the control circuit transmits CT to the first-stage LED driver circuit, the first-stage LED driver circuit may output 0 to the LED driver circuit in its next stage, that is, the first-stage LED driver circuit performs power saving data transmission. In addition, the LED driver circuit in each stage except for the first-stage LED driver circuit has also received the power saving command issued by the control circuit and entered the power saving mode, so it may output 0 to the LED driver circuit in its next stage, that is, the LED driver circuit in each stage except for the first-stage LED driver circuit performs power saving data transmission. In addition, it is also possible to appropriately shut down (make it inoperative) some circuits in the transmitter of the LED driver circuit in each stage to achieve a better power saving effect.

In addition, in the second example, the LED driver circuit in each stage may judge whether a time period during which it receives specific data from its upstream circuit is greater than a preset threshold. When the time period during which the LED driver circuit in the stage receives the specific data from its upstream circuit is greater than the preset threshold, the LED driver circuit in the stage changes the determined operation mode into the power saving mode. When the time period during which the LED driver circuit in the stage receives the specific data from its upstream circuit is not greater than the preset threshold, the LED driver circuit in the stage does not change the determined operation mode into the power saving mode. For the first-stage LED driver circuit, its upstream circuit is the control circuit, and for the LED driver circuit in each stage except for the first-stage LED driver circuit, its upstream circuit is the LED driver circuit in its previous stage.

In addition, in this example, each LED driver circuit may start a timer when it detects the specific data, and the duration of the timer is a preset threshold. When the time period of the preset threshold expires, if the specific data is still detectable by the LED driver circuit, the LED driver circuit may change the current operation mode to the power saving mode.

In addition, in this example, the control circuit may also indicate the LED driver circuit in each stage to end the power saving mode. For example, the control circuit may change a level of a synchronization signal (for example, from a high level to a low level, or from a low level to a high level) transmitted by the control circuit to the LED driver circuit in each stage. Correspondingly, the LED driver circuit in each stage may end the power saving mode after detecting the change in the level of the synchronization signal.

After the power saving mode is ended, the display driver system may prepare for the next write/read operation.

In a power on protection mode, the control circuit may be configured to change a level of a synchronous signal transmitted by the control circuit to the LED driver circuit in each stage according to a preset cycle. For example, the control circuit may change the level of the synchronization signal transmitted by the control circuit to the LED driver circuit in each stage from a high level to a low level according to the preset cycle, or the control circuit may change the level of the synchronization signal transmitted by the control circuit to the LED driver circuit in each stage from a low level to a high level according to the preset cycle.

In addition, the control circuit may be configured to transmit first preset data to the first-stage LED driver circuit after the control circuit is powered on and before the control circuit transmits the global signal and the first signal for the LED driver circuit in each stage to the first-stage LED driver circuit in the multi-stage LED driver circuit.

In addition, the LED driver circuit in each stage in the multi-stage LED driver circuit may be configured to: transmit second preset data to its downstream circuit when the first preset data is not received or when the first preset data is received but the level of the synchronization signal has not changed for a preset number of times (for example, 2 times); and transmit the first preset data to its downstream circuit when the first preset data is received and the level of the synchronization signal has changed for the preset number of times.

In addition, the control circuit may be configured to, in response to receiving the first preset data from the LED driver circuit in the last stage, start to transmit the global signal and the first signal for the LED driver circuit in each stage to the first-stage LED driver circuit in the multi-stage LED driver circuit, so as to perform the write/read operation.

Through the above method, after the control circuit receives the first preset data fed back by the LED driver circuit in the last stage, the control circuit and the LED driver circuit in each stage enter the normal state together to perform the write/read operation.

Through the display driver system of the above embodiments, through the specific signal transmission protocol, each LED driver circuit may identify the data that is to be transmitted from the control circuit to itself, so that no additional pins or chip select signals are required to determine the corresponding LED driver circuit, thereby avoiding the use of SPI and thus avoiding some defects caused by SPI. In addition, the power saving mode is set for the display driver system, which may save power consumption and effectively reduce chip power consumption. In addition, the power on protection mode is set for the display driver system, which may greatly improve the ESD tolerance of the chip, thereby extending the life of the chip. In addition, the data signal and clock signal are transmitted in the differential manner, so that the data signal and clock signal may be transmitted with a small voltage swing (about hundreds of mV), thereby effectively suppressing the influence of noise and increasing the signal transmission speed. In addition, transmitting the clock signal in sequence may improve the distortion of the clock signal.

Although the present invention has been disclosed in the above embodiments, the above embodiments are not intended to limit the present invention. Anyone with ordinary knowledge in the technical field may make some changes and modifications without departing from the spirit and scope of the present invention. Therefore, the protection scope of the present invention shall be subject to those defined by the appended claims.

The invention claimed is:

1. A method for a display driver system, wherein the display driver system includes a control circuit and a cascade-connected multi-stage light emitting diode (LED) driver circuit, and the method comprises:

transmitting, by the control circuit, a global signal and a first signal for a LED driver circuit in each stage to a first-stage LED driver circuit in the multi-stage LED driver circuit, wherein the global signal includes a command for indicating an operation mode of the LED driver circuit in each stage;

determining, by the LED driver circuit in each stage, the operation mode corresponding to the command according to the global signal, identifying a corresponding first signal of the LED driver circuit in the stage, and operating according to the determined operation mode and the corresponding first signal; and transmitting, by the LED driver circuit in each stage except for the LED driver circuit in last stage, the global signal to the LED driver circuit in its next stage, and in response to a completion of operation according to the determined operation mode and the corresponding first signal, transmitting the first signal for the LED driver circuit in each stage after the LED driver circuit in the stage to the LED driver circuit in its next stage, wherein, the command is a write command, and the operation mode corresponding to the command is a write mode; or the command is a read command, and the operation mode corresponding to the command is a read mode;

in case that the command is the write command, the first signal for the LED driver circuit in each stage at least includes data to be written for the LED driver circuit in the stage, the LED driver circuit in each stage in the multi-stage LED driver circuit operating according to the determined operation mode and the corresponding first signal comprises:

transmitting preset data to a downstream circuit of the LED driver circuit in the stage in case that the data to be written for the LED driver circuit in the stage is not received;

writing the data to be written for the LED driver circuit in the stage and transmitting the preset data to its downstream circuit in case that the data to be written for the LED driver circuit in the stage is received;

wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage.

2. The method of claim 1, wherein, in case that the command is the read command, the first signal for the LED driver circuit in each stage includes first data and second data for the LED driver circuit in the stage, wherein the first data includes an enable command.

3. The method of claim 2, wherein the control circuit transmitting the first signal for the LED driver circuit in each stage to the first-stage LED driver circuit in the multi-stage LED driver circuit comprises:

the control circuit transmitting the first signal for the LED driver circuit in an i-th stage in a preset time period corresponding to the LED driver circuit in the i-th stage, wherein the preset time period includes a first time period and a second time period, and the control circuit transmits the first data for the LED driver circuit in the i-th stage in the first time period and transmits the second data for the LED driver circuit in the i-th stage in the second time period, wherein, the multi-stage LED driver circuit is an N-stage LED driver circuit, N is an integer greater than or equal to 3, and i is an integer greater than or equal to 1 and less than or equal to N.

4. The method of claim 3, wherein, the LED driver circuit in each stage in the multi-stage LED driver circuit operating according to the determined operation mode and the corresponding first signal comprises:

receiving the first data for the LED driver circuit in the stage in the first time period corresponding to the LED driver circuit in the stage, and transmitting preset data to its downstream circuit;

identifying the enable command in the first data for the LED driver circuit in the stage;

receiving the second data for the LED driver circuit in the stage in the second time period corresponding to the LED driver circuit in the stage, and in response to the enable command, transmitting data to be read stored in the LED driver circuit in the stage to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage.

5. The method of claim 4, further comprising:

for the LED driver circuit in each stage except for the first-stage LED driver circuit in the multi-stage LED driver circuit, transmitting data received from the LED driver circuit in its previous stage to its downstream circuit in one or more preset time periods before the first time period corresponding to the LED driver circuit in the stage, comprising:

in a first time period included in the one or more preset time periods before the first time period corresponding to the LED driver circuit in the stage, receiving the preset data from the LED driver circuit in its previous stage, and transmitting the preset data to its downstream circuit; and in a second time period included in the one or more preset time periods, receiving the data to be read which is from the LED driver circuit in its previous stage from the LED driver circuit in its previous stage, and transmitting the data to be read which is from the LED driver circuit in its previous stage to its downstream circuit.

6. The method of claim 1, further including:

the control circuit transmitting a second global signal to the first-stage LED driver circuit in the multi-stage LED driver circuit, wherein the second global signal includes an command for indicating a second operation mode of the LED driver circuit in each stage;

the LED driver circuit in each stage determining the second operation mode according to the second global signal;

the LED driver circuit in each stage operating according to the second operation mode; and the LED driver circuit in each stage except for the LED driver circuit in the last stage transmitting the second global signal to the LED driver circuit in its next stage.

7. The method of claim 6, wherein, the command for indicating the second operation mode of the LED driver circuit in each stage is a power saving command, and the second operation mode is a power saving mode.

8. The method of claim 7, wherein, the LED driver circuit in each stage in the multi-stage LED driver circuit operating according to the second operation mode includes:

the LED driver circuit in the stage disabling at least data transmission function; or the LED driver circuit in the stage transmitting preset data to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage.

9. The method of claim 1, wherein, for the LED driver circuit in each stage in the multi-stage LED driver circuit, the method further comprises:

the LED driver circuit in the stage judging whether a time period during which it receives specific data from its upstream circuit is greater than a preset threshold; and the LED driver circuit in the stage changing the determined operation mode into a power saving mode in case that the time period during which it receives the specific data from its upstream circuit is greater than the preset threshold, wherein, for the first-stage LED driver circuit, its upstream circuit is the control circuit, and for the LED driver circuit in each stage except for the first-stage LED driver circuit, its upstream circuit is the LED driver circuit in its previous stage.

10. The method of claim 1, further comprising:

the control circuit changing a level of a synchronous signal transmitted by the control circuit to the LED driver circuit in each stage according to a preset cycle;

the control circuit transmitting first preset data to the first-stage LED driver circuit after the control circuit is powered on and before the control circuit transmits the global signal and the first signal for the LED driver circuit in each stage to the first-stage LED driver circuit in the multi-stage LED driver circuit;

the LED driver circuit in each stage in the multi-stage LED driver circuit performing the following operations: transmitting second preset data to its downstream circuit when the first preset data is not received or when the first preset data is received but the level of the synchronization signal has not changed for a preset number of times; transmitting the first preset data to its downstream circuit when the first preset data is received and the level of the synchronization signal has changed for the preset number of times; wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage;

in response to receiving the first preset data from the LED driver circuit in the last stage, the control circuit starting transmitting the global signal and the first signal for the LED driver circuit in each stage to the first-stage LED driver circuit in the multi-stage LED driver circuit.

11. The method of claim 1, wherein, the LED driver circuit in each stage is applied to drive a display with Micro LEDs as display pixels.

12. A display driver system, comprising:

a control circuit and a cascade-connected multi-stage LED driver circuit, wherein the control circuit is configured to transmit a global signal and a first signal for a LED driver circuit in each stage to the first-stage LED driver circuit in the multi-stage LED driver circuit, wherein the global signal includes a command for indicating an operation mode of the LED driver circuit in each stage;

the LED driver circuit in each stage is configured to determine the operation mode corresponding to the command according to the global signal, identify a corresponding first signal for the LED driver circuit in the stage, and operate according to the determined operation mode and the corresponding first signal; and the LED driver circuit in each stage except for the LED driver circuit in the last stage is further configured to transmit the global signal to the LED driver circuit in its next stage, and in response to a completion of operation according to the determined operation mode and the corresponding first signal, transmit the first signal for the LED driver circuit in each stage after the LED driver circuit in the stage to the LED driver circuit in its next stage, wherein, the command is a write command, and the operation mode corresponding to the command is a write mode; or the command is a read command, and the operation mode corresponding to the command is a read mode;

in case that the command is the write command, the first signal for the LED driver circuit in each stage at least includes data to be written for the LED driver circuit in the stage, the LED driver circuit in each stage in the multi-stage LED driver circuit is configured to:

transmit preset data to a downstream circuit of the LED driver circuit in the stage in case that the data to be written for the LED driver circuit in the stage is not received;

write the data to be written for the LED driver circuit in the stage and transmitting the preset data to its downstream circuit in case that the data to be written for the LED driver circuit in the stage is received;

wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage.

13. The display driver system of claim 12, wherein, in case that the command is the read command, the first signal for the LED driver circuit in each stage includes first data and second data for the LED driver circuit in the stage, wherein the first data includes an enable command.

14. The display driver system of claim 13, wherein, the control circuit is configured to transmit the first signal for the LED driver circuit in an i-th stage in a preset time period corresponding to the LED driver circuit in the i-th stage, wherein the preset time period includes a first time period and a second time period, and the control circuit transmits the first data for the LED driver circuit in the i-th stage in the first time period and transmits the second data for the LED driver circuit in the i-th stage in the second time period, wherein, the multi-stage LED driver circuit is an N-stage LED driver circuit, N is an integer greater than or equal to 3, and i is an integer greater than or equal to 1 and less than or equal to N.

15. The display driver system of claim 14, wherein, the LED driver circuit in each stage in the multi-stage LED driver circuit is configured to: receive the first data for the LED driver circuit in the stage in the first time period corresponding to the LED driver circuit in the stage, and transmit preset data to its downstream circuit; identify the enable command in the first data for the LED driver circuit in the stage; receive the second data for the LED driver circuit in the stage in the second time period corresponding to the LED driver circuit in the stage, and in response to the enable command, transmitting data to be read stored in the LED driver circuit in the stage to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage.

16. The display driver system of claim 15, wherein, the LED driver circuit in each stage except for the first-stage LED driver circuit in the multi-stage LED driver circuit is configured to:

in a first time period included in one or more preset time periods before the first time period corresponding to the LED driver circuit, receive the preset data from the LED driver circuit in its previous stage, and transmit the preset data to its downstream circuit; and in a second time period included in the one or more preset time periods, receive the data to be read which is from the LED driver circuit in its previous stage from the LED driver circuit in its previous stage, and transmit the data to be read which is from the LED driver circuit in its previous stage to its downstream circuit.

17. The display driver system of claim 12, wherein, the control circuit is configured to transmit a second global signal to the first-stage LED driver circuit in the multi-stage LED driver circuit, wherein the second global signal includes an command for indicating a second operation mode of the LED driver circuit in each stage;

the LED driver circuit in each stage is configured to determine the second operation mode according to the second global signal;

the LED driver circuit in each stage is configured to operate according to the second operation mode; and the LED driver circuit in each stage except for the LED driver circuit in the last stage is configured to transmit the second global signal to the LED driver circuit in its next stage.

18. The display driver system of claim 17, wherein, the command for indicating the second operation mode of the LED driver circuit in each stage is a power saving command, and the second operation mode is a power saving mode.

19. The display driver system of claim 18, wherein, the LED driver circuit in each stage in the multi-stage LED driver circuit is configured to disable at least data transmission function or transmit preset data to its downstream circuit, wherein, for the LED driver circuit in the last stage, its downstream circuit is the control circuit, and for the LED driver circuit in each stage except for the LED driver circuit in the last stage, its downstream circuit is the LED driver circuit in its next stage.

20. The display driver system of claim 12, wherein, the LED driver circuit in each stage in the multi-stage LED driver circuit is further configured to judge whether a time period during which it receives specific data from its upstream circuit is greater than a preset threshold; and the LED driver circuit in each stage changes the determined operation mode into a power saving mode in case that the time period during which it receives the specific data from its upstream circuit is greater than the preset threshold, wherein, for the first-stage LED driver circuit, its upstream circuit is the control circuit, and for the LED driver circuit in each stage except for the first-stage LED driver circuit, its upstream circuit is the LED driver circuit in its previous stage.

21. The display driver system of claim 12, wherein the control circuit is configured to change a level of a synchronous signal transmitted by the control circuit to the LED driver circuit in each stage according to a preset cycle;

the control circuit is configured to transmit first preset data to the first-stage LED driver circuit after the control circuit is powered on and before the control circuit transmits the global signal and the first signal for the LED driver circuit in each stage to the first-stage LED driver circuit in the multi-stage LED driver circuit;

the LED driver circuit in each stage in the multi-stage LED driver circuit is configured to perform the following operations: transmitting second preset data to its downstream circuit when the first preset data is not received or when the first preset data is received but the level of the synchronization signal has not changed for a preset number of times; transmitting the first preset data to its downstream circuit when the first preset data is received and the level of the synchronization signal has changed for the preset number of times; wherein, for the LED driver circuit in the last stage in the multi-stage LED driver circuit, its downstream circuit is the control circuit, and for the LED driver circuit in each stage except for the LED driver circuit in the last stage in the multi-stage LED driver circuit, its downstream circuit is the LED driver circuit in its next stage;

the control circuit starting is configured to, in response to receiving the first preset data from the LED driver circuit in the last stage, start transmitting the global signal and the first signal for the LED driver circuit in each stage to the first-stage LED driver circuit in the multi-stage LED driver circuit.

22. The display driver system of claim 12, wherein, the LED driver circuit in each stage is applied to drive a display with Micro LEDs as display pixels.

* * * * *